US007806501B2

(12) United States Patent
Nagumo

(10) Patent No.: US 7,806,501 B2
(45) Date of Patent: Oct. 5, 2010

(54) DRIVING APPARATUS, LED HEAD AND IMAGE FORMING APPARATUS

(75) Inventor: Akira Nagumo, Tokyo (JP)

(73) Assignee: Oki Data Corporation, Tokyo (JP)

( * ) Notice: Subject to any disclaimer, the term of this patent is extended or adjusted under 35 U.S.C. 154(b) by 858 days.

(21) Appl. No.: 11/693,911

(22) Filed: Mar. 30, 2007

(65) Prior Publication Data

US 2008/0007500 A1 Jan. 10, 2008

(30) Foreign Application Priority Data

Mar. 31, 2006 (JP) ..... 2006-097790

(51) Int. Cl.
*B41J 29/393* (2006.01)

(52) U.S. Cl. ..... 347/19; 347/237

(58) Field of Classification Search ..... 347/9–11, 347/19, 128, 142, 237
See application file for complete search history.

(56) References Cited

U.S. PATENT DOCUMENTS 6,498,616 B1 * 12/2002 Nagumo et al. ..... 347/237
6,608,642 B1 * 8/2003 Omae ..... 347/237
7,301,552 B2 * 11/2007 Sato ..... 347/237

FOREIGN PATENT DOCUMENTS

JP 2002-248805 9/2002

* cited by examiner

*Primary Examiner*—Lamson D Nguyen
(74) *Attorney, Agent, or Firm*—Rabin & Berdo, P.C.

(57) ABSTRACT

A common data line serially connects a first dot memory group and a second dot memory group in layout order of driven devices so as to form each pair. First word lines are connected to the first dot memory group. Second word lines are connected to the second dot memory group. A data writing section supplies the correction values for the first dot memory group and the correction values for the second dot memory group while shifting the timing and supplies writing signals to the first word lines and the second word lines at predetermined timing. A chip area is reduced and costs of a driving apparatus is reduced.

12 Claims, 18 Drawing Sheets

100
CTRL3
EVEN
ODD
ADJ
MEM(T)
SKL
DATAO3
DATAO2
DATAO1
DATAO0
E2
DRV (D1)
DRV (C1)
DRV (B1)
DRV (A1)
DRV (D24)
DRV (C24)
DRV (B24)
DRV (A24)
CTRL2
CTRL1
(DRV-ON)
STB
(HD-STB-N)
HSYNC
LOAD
LOAD-P
DATA13
DATA12
DATA11
DATA10
SEL
CLK-P
CLK-N
201
202
203
204
205
206
207

500
CTRL33
EVEN
ODD
131
132
133
134
ADJ
MEM(T)
SKL
E2
DATAO3
DATAO2
DATAO1
DATAO0
DRV (A24)
DRV (B24)
DRV (C24)
DRV (D24)
DRV (A1)
DRV (B1)
DRV (C1)
DRV (D1)
CTRL2
CTRL1
(DRV-ON)
STB
(HD-STB-N)
HSYNC
LOAD
LOAD-P
DATA13
DATA12
DATA11
DATA10
SEL
CLK-P
CLK-N
201
202
203
204
205
206
207

DRIVING APPARATUS, LED HEAD AND IMAGE FORMING APPARATUS

BACKGROUND OF THE INVENTION

1. Field of the Invention

The invention relates to a driving apparatus for driving a driven device array in which a plurality of light emitting devices, exothermic resistors, or the like are arranged, an LED head having the driving apparatus, and an image forming apparatus.

2. Description of the Related Art

Hitherto, among image forming apparatuses such as a printer and the like, there is an apparatus in which driven devices (that is, devices which are driven) in an array shape, for example, an LED (Light Emitting Diode) array is used as a light source, the LED devices are selectively driven, and an image is formed. In a driving apparatus which is used for such an image forming apparatus, in order to obtain an image of high quality at low costs, it is necessary to have a memory cell circuit for storing correction values to correct a variation in electric characteristics every driving device in an IC (Integrated Circuit) so as to drive each driven device (LED device here) by a uniform electric energy. A tremendous effort is made to realize storing means of the correction values at the low costs (refer to JP-A-2002-248805).

In such a memory cell circuit having the image forming apparatus in the related art, a plurality of dot memories (constructed by a plurality of memory cells) for storing, every driven device, correction values of powers which are applied to the driven devices are divided into a first dot memory group and a second dot memory group which are alternately distributed in layout order of the plurality of driven devices, the memory cell circuit has data lines which are individually arranged for every first and second dot memories and a common word line which is arranged in common for the first dot memory group and the second dot memory group, and the correction values are stored into the dot memories by using the data lines and the common word line.

In a multiplexer circuit which switches reading positions when the correction values are read out of the dot memories, the dot memories belonging to the first dot memory group and the dot memories belonging to the second dot memory group are connected as pairs in the layout order of the driven devices, and buffer circuits are provided in an input portion of the multiplexer circuit in order to prevent inversion of the memory storage data which is caused by data collision when the pair of dot memories are switched every dot memory and the data is read out therefrom.

There are the following main problems to be solved by the invention. In the memory cell circuit, the number of path transistors which are connected to the data lines arranged every dot memory is very large. The number of the data lines and word lines is large and a chip area increases. Thus, it becomes a cause of obstruction to reduction in costs of the driving apparatus. The invention intends to solve the above main problems and reduce the costs of the driving apparatus.

SUMMARY OF THE INVENTION

It is an object of the invention to provide a driving apparatus for driving a driven device array in which a plurality of light emitting devices, exothermic resistors, or the like are arranged, an LED head having the driving apparatus, and an image forming apparatus.

According to the present invention, there is provided a driving apparatus for driving a plurality of driven devices which are arranged in accordance with a predetermined rule, comprising:

a first dot memory group and a second dot memory group in which a plurality of dot memories for storing correction values of powers which are applied to the driven devices every the driven device are alternately distributed in layout order of the plurality of driven devices;

a common data line which serially connects the first dot memory group and the second dot memory group in the layout order of the driven devices so as to form each pair;

first word lines connected to all of the dot memories of the first dot memory group;

second word lines connected to all of the dot memories of the second dot memory group; and a data writing section which supplies the correction values for the first dot memory group and the correction values for the second dot memory group to the common data line in accordance with the layout order of the driven devices while shifting timing and supplies writing signals to the first word lines and the second word lines at predetermined timing.

Moreover, in the driving apparatus, each of a plurality of the memory cells constructing the dot memory may be formed by two inverters which are mutually serially connected, and the data writing section may have an MOS transistor in which a first electrode is connected to the inverters, a second electrode is connected to the common data line, and a gate electrode is connected to either the first word line or the second word line.

Further, according to the present invention, there is also provided a driving apparatus for driving a plurality of driven devices which are arranged in accordance with a predetermined rule, comprising:

a first dot memory group and a second dot memory group in which a plurality of dot memories for storing correction values of powers which are applied to the driven devices every the driven device are alternately distributed in layout order of the plurality of driven devices;

a common word line which connects the first dot memory group and the second dot memory group in common;

first data lines connected to the dot memories of the first dot memory group;

second data lines connected to the dot memories of the second dot memory group; and a data writing section which sets the first data lines and the second data lines to data line pairs in the layout order of the driven devices, supplies the correction values for the first dot memory group and the correction values for the second dot memory group to each of the data line pairs in accordance with the layout order of the driven devices while shifting timing, and supplies writing signals to the common word line at predetermined timing.

Moreover, in the driving apparatus, each of the memory cells constructing the dot memory may be formed by two inverters which are mutually serially connected, and the data writing section may have a first MOS transistor in which a first electrode is connected to the inverters and a gate electrode is connected to the common word line; and a second MOS transistor in which a first electrode is connected to a second electrode of the first MOS transistor, a second electrode is connected to the first data line or the second data line, and a gate electrode is connected to a data signal selecting line, and on the basis of a switching signal which is received through the data signal selecting line, the data writing section switches the supply of the correction values for the first dot memory group and the supply of the correction values for the second dot memory group while shifting the timing every the first dot memory group and the second dot memory group.

Moreover, the driving apparatus may further comprise a third dot memory group, and a fourth dot memory group in which a plurality of dot memories for storing correction values of powers which are applied to the driven devices every the driven device are alternately distributed in layout order of the plurality of driven devices; third data lines connected to the dot memories of the third dot memory group; and fourth data lines connected to the dot memories of the fourth dot memory group, wherein the common word line connects the first dot memory group, the second dot memory group, the third dot memory group, and the fourth dot memory group in common; and the data writing section sets the first data lines, the second data lines, the third data lines, and the fourth data lines to data line groups in the layout order of the driven devices, supplies the correction values for the first dot memory group, the correction values for the second dot memory group, the correction values for the third dot memory group, and the correction values for the fourth dot memory group to each of the data line groups in accordance with the layout order of the driven devices while shifting timing, and supplies writing signals to the common word line at predetermined timing.

Moreover, in the driving apparatus, each of the memory cells constructing the dot memory may be formed by two inverters which are mutually serially connected, and the data writing section may have first MOS transistor in which a first electrode is connected to the inverters and a gate electrode is connected to the common word line; and second MOS transistor in which a first electrode is connected to a second electrode of the first MOS transistor, a second electrode is connected to one of the first data line, the second data line, the third data line, and the fourth data line, and a gate electrode is connected to a data signal selecting line, and on the basis of a switching signal which is received through the data signal selecting line, the data writing section switches the supply of the correction values for the first dot memory group, the supply of the correction values for the second dot memory group, the supply of the correction values for the third dot memory group, and the supply of the correction values for the fourth dot memory group while shifting the timing every the first dot memory group, the second dot memory group, the third dot memory group, and the fourth dot memory group.

Furthermore, according to the present invention, there is also provided a driving apparatus for driving a plurality of driven devices which are arranged in accordance with a predetermined rule, comprising:

a first dot memory group and a second dot memory group in which a plurality of dot memories for storing correction values of powers which are applied to the driven devices every the driven device are alternately distributed in layout order of the plurality of driven devices;

a correction value reading section which connects the dot memories of the first dot memory group and the dot memories of the second dot memory group in the layout order of the driven devices so as to form each pair;

a reading position switching section which switches the reading of the correction values of the first dot memory group and the reading of the correction values of the second dot memory group which are executed by the correction value reading section while shifting timing; and a switching signal generating section which supplies a switching signal to the reading position switching section, wherein the switching signal generating section supplies the switching signal to the reading position switching section and allows timing for turning off the switching signal to be included in a period of time until a subsequent switching signal is supplied.

Moreover, the driving apparatus may further comprise a third dot memory group, and a fourth dot memory group in which a plurality of dot memories for storing correction values of powers which are applied to the driven devices every the driven device are alternately distributed in layout order of the plurality of driven devices, wherein the correction value reading section which connects the dot memories of the first dot memory group, the dot memories of the second dot memory group, the dot memories of the third dot memory group, the dot memories of the fourth dot memory group in the layout order of the driven devices so as to form each group; and the reading position switching section which switches the reading of the correction values of the first dot memory group, the reading of the correction values of the second dot memory group, the reading of the correction values of the third dot memory group, the reading of the correction values of the fourth dot memory group which are executed by the correction value reading section while shifting timing.

Moreover, the driving apparatus may further comprise a first driven device group and a second driven device group in which first electrodes of the adjacent devices among the driven devices are mutually connected and second electrodes of the driven devices are alternately distributed in the layout order of the plurality of driven devices; a first power MOS transistor connected to the second electrodes of all of the driven devices belonging to the first driven device group; a second power MOS transistor connected to the second electrodes of all of the driven devices belonging to the second driven device group; and a drive switching section which allows the second electrodes of the driven devices to be alternately connected to the ground through both of the first and second power MOS transistors.

Moreover, the driving apparatus may further comprise a first driven device group, a second driven device group, a third driven device group, and a fourth driven device group in which first electrodes of the four adjacent devices among the driven devices are mutually connected and second electrodes of the driven devices are alternately distributed in the layout order of the plurality of driven devices; a first power MOS transistor connected to the second electrodes of all of the driven devices belonging to the first driven device group; a second power MOS transistor connected to the second electrodes of all of the driven devices belonging to the second driven device group; a third power MOS transistor connected to the third electrodes of all of the driven devices belonging to the third driven device group; a fourth power MOS transistor connected to the fourth electrodes of all of the driven devices belonging to the fourth driven device group; and a drive switching section which allows the second electrodes of the driven devices to be alternately connected to the ground through the first to fourth power MOS transistors.

Further, according to the present invention, there is provided an LED head comprising:

a driving apparatus for driving a plurality of driven devices which are arranged in accordance with a predetermined rule; and LED (Light Emitting Diode) devices as the driven devices which are driven by the driving apparatus, wherein the driving apparatus includes:

a first dot memory group and a second dot memory group in which a plurality of dot memories for storing correction values of powers which are applied to the driven devices every the driven device are alternately distributed in layout order of the plurality of driven devices;

a common data line which serially connects the first dot memory group and the second dot memory group in the layout order of the driven devices so as to form each pair;

first word lines connected to all of the dot memories of the first dot memory group;

second word lines connected to all of the dot memories of the second dot memory group; and a data writing section which supplies the correction values for the first dot memory group and the correction values for the second dot memory group to the common data line in accordance with the layout order of the driven devices while shifting timing and supplies writing signals to the first word lines and the second word lines at predetermined timing.

Furthermore, according to the present invention, there is provided an image forming apparatus, comprising:

a LED head, wherein the LED head includes:

a driving apparatus for driving a plurality of driven devices which are arranged in accordance with a predetermined rule; and LED (Light Emitting Diode) devices as the driven devices which are driven by the driving apparatus, wherein the driving apparatus includes:

a first dot memory group and a second dot memory group in which a plurality of dot memories for storing correction values of powers which are applied to the driven devices every the driven device are alternately distributed in layout order of the plurality of driven devices;

a common data line which serially connects the first dot memory group and the second dot memory group in the layout order of the driven devices so as to form each pair;

first word lines connected to all of the dot memories of the first dot memory group;

second word lines connected to all of the dot memories of the second dot memory group; and a data writing section which supplies the correction values for the first dot memory group and the correction values for the second dot memory group to the common data line in accordance with the layout order of the driven devices while shifting timing and supplies writing signals to the first word lines and the second word lines at predetermined timing.

wherein an image is formed by allowing a plurality of the LED devices included in the LED head to selectively perform light emission.

According to the present invention, in the pair of first and second dot memories, since they are connected by one data line in place of the two complementary data lines, the number of path transistors which are connected to the data line can be reduced into ½. Therefore, such an effect that the area of the IC chip can be reduced and it is possible to contribute to the cost reduction of the LED head is obtained.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

In addition to the foregoing problem to be solved, by providing a first power MOS transistor as switching means which is connected to cathode electrodes of all LED devices belonging to a first LED device group and a second power MOS transistor which is connected to cathode electrodes of all LED devices belonging to a second LED device group, as compared with the case of using a bipolar transistor like a construction in the related art, an ON-voltage in the switching means can be reduced and no change is required in a printer power supplying apparatus. An LED head in which an ON-resistance is suppressed to a small value although a chip area is small is realized.

Embodiment 1

An embodiment 1 relates to a memory cell circuit for coping with the problems to be solved by the invention. Prior to explaining the memory cell circuit according to the embodiment, a schematic construction of a whole driver IC including the memory cell circuit according to the embodiment will be described and, thereafter, details of the memory cell circuit will be described.

Figure 1:
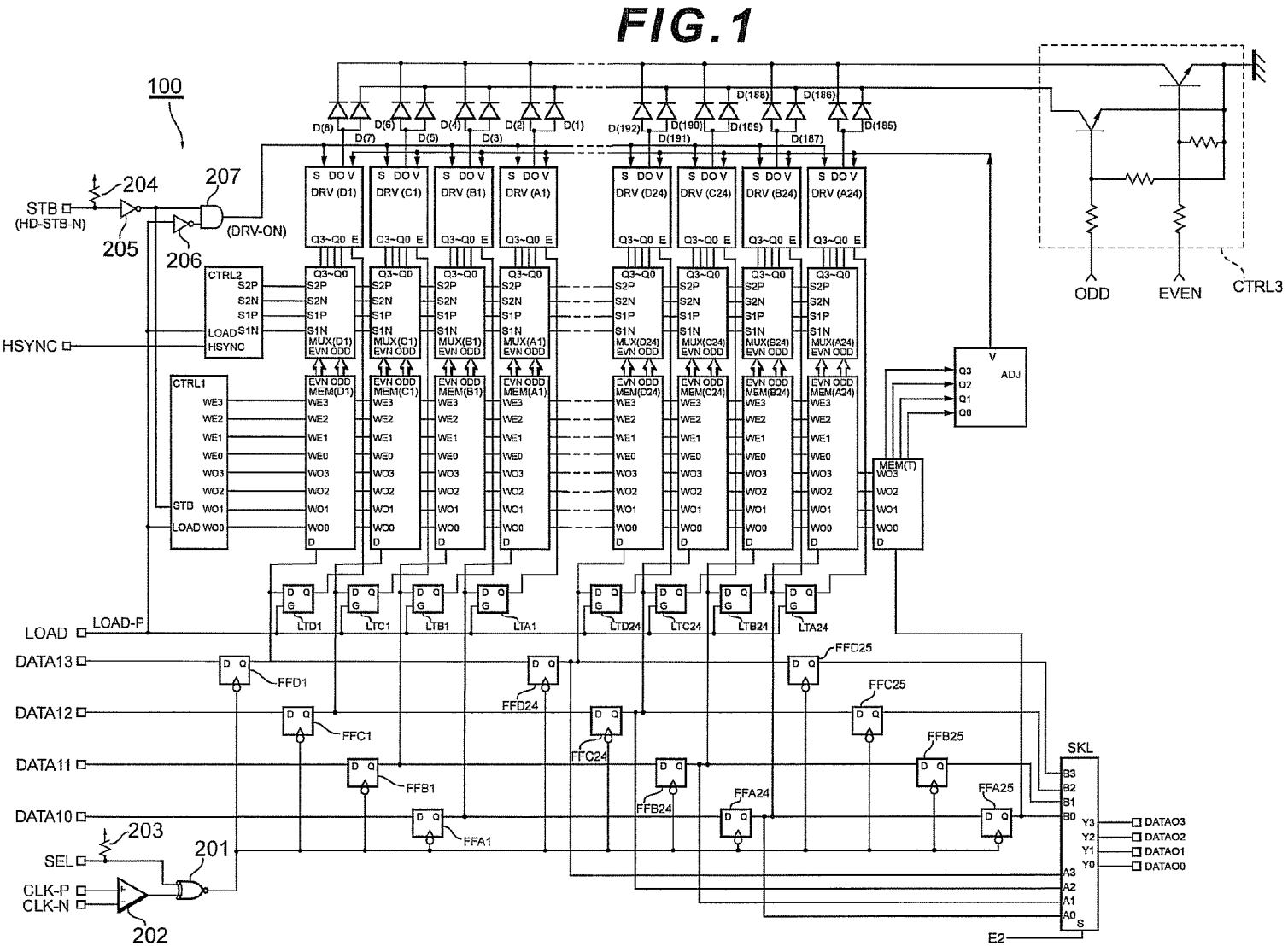
FIG. 1 is a block constructional diagram of a driver IC according to an embodiment 1.

FIG. 1 is a block constructional diagram of a driver IC according to an embodiment 1.

For example, 26 driver ICs are cascade-connected and assembled into an image forming apparatus in a form of an LED head obtained by combining those driver ICs with LED devices as corresponding driven devices. Explanation will be made hereinbelow with respect to only one driver IC.

In the invention, for example, as shown in the diagram, explanation will be made by limiting to the case where 192 LED devices D(1) to D(192) are arranged and connected to one LED driving circuit in layout order of those LED devices so that the adjacent LED devices form one pair and they are controlled. In this example, explanation will be made on the assumption that anodes (first electrodes) of the adjacent LED devices are mutually connected, cathodes (second electrodes) of the LED devices are alternately distributed in the layout order, a set of the odd-number designated LED devices is set to a first LED device group, and a set of the even-number designated LED devices is set to a second LED device group.

As shown in the diagram, a driver IC 100 of the embodiment 1 has: flip-flops FFA1 to FFA25 constructing a shift register circuit of an A group; flip-flops FFB1 to FFB25 constructing a shift register circuit of a B group; flip-flops FFC1 to FFC25 constructing a shift register circuit of a C group; flip-flops FFD1 to FFD25 constructing a shift register circuit of a D group; latch circuits LTA1 to LTA24 constructing a latch circuit of the A group; latch circuits LTB1 to LTB24 constructing a latch circuit of the B group; latch circuits LTC1 to LTC24 constructing a latch circuit of the C group; latch circuits LTD1 to LTD24 constructing a latch circuit of the D group; memory cell circuits MEM(A1) to MEM(A24) of the A group; memory cell circuits MEM(B1) to MEM(B24) of the B group; memory cell circuits MEM (C1) to MEM(C24) of the C group; memory cell circuits MEM(D1) to MEM(D24) of the D group; multiplexer circuits MUX(A1) to MUX(A24) of the A group; multiplexer circuits MUX(B1) to MUX(B24) of the B group; multiplexer circuits MUX(C1) to MUX(C24) of the C group; multiplexer circuits MUX(D1) to MUX(D24) of the D group; LED driving circuits DRV(A1) to DRV(A24) of the A group; LED driving circuits DRV(B1) to DRV(B24) of the B group; LED driving circuits DRV(C1) to DRV(C24) of the C group; and LED driving circuits DRV(D1) to DRV(D24) of the D group. As memory cell circuits, the memory circuits according to the embodiment are used and component elements which have conventionally been well known are used in the other portions.

The shift register circuit of the A group, the latch circuit of the A group, the memory cell circuits of the A group, the multiplexer circuits of the A group, and the LED driving circuits of the A group are connected in the vertical direction in the diagram through their data signals. Similarly, the shift register circuit of the B group, the latch circuits of the B group, the memory cell circuits of the B group, the multiplexer circuits of the B group, and the LED driving circuits of the B group are connected in the vertical direction in the diagram through their data signals. Similarly, the shift register circuit of the C group, the latch circuits of the C group, the memory cell circuits of the C group, the multiplexer circuits of the C group, and the LED driving circuits of the C group are connected in the vertical direction in the diagram through their data signals. Similarly, the shift register circuit of the D group, the latch circuits of the D group, the memory cell circuits of the D group, the multiplexer circuits of the D group, and the LED driving circuits of the D group are connected in the vertical direction in the diagram through their data signals.

However, the flip-flops FFB25, FFC25, and FFD25 of the shift register circuits are not connected to the latch circuits of the A to D groups. The flip-flop FFA25 is connected to a total cell circuit MEM(T). The shift register circuits of the four groups A, B, C, and D receive clock signals CLK in their flip-flop circuits from an exclusive NOR (EX-NOR) circuit 201 and receive data signals from input terminals DATA10 to DATA13, respectively. VREF denotes a reference voltage input terminal and is connected to a reference voltage circuit (not shown).

By providing the shift registers of four groups as mentioned above, the adjacent 4-bit data can be transferred in a lump by the clock of one time. Thus, a clock frequency (frequency of the clock signal CLK) of data transfer can be lowered. By using such a construction that not only print data but also light amount correction data (correction values) are transferred by the shift registers of four groups mentioned above, the number of terminals of each IC is reduced. Thus, a step of connecting the driver ICs by a bonding wire is simplified. A chip size of the driver IC decreases.

The EX-NOR circuit 201 forms a clock signal CLK-P for the shift registers from an output signal of a differential clock inputting circuit 202 in accordance with a logic level of a selecting terminal SEL. An AND gate 207 forms a drive control signal DRV-ON for the LED driving circuit DRV on the basis of a strobe signal HD-STB-N which is inputted to a terminal STB and a latch signal LOAD-P which is inputted from a terminal LOAD. Reference numerals 205 and 206 denote inverters and 203 and 204 indicate pull-up resistors.

The driver IC 100 has control circuits CTRL1, CTRL2, and CTRL3, the total cell circuit MEM(T), and a control voltage generating circuit ADJ as control system circuits.

The control circuit CTRL1 is a circuit for receiving the latch signal LOAD-P from the LOAD terminal, receiving the strobe signal HD-STB-N through the inverter 205, and outputting data writing signals (wo0, wo1, wo2, wo3, we0, we1, we2, we3) to the memory cell circuits MEM(A1) to MEM (D24), respectively.

The control circuit CTRL2 is a portion for receiving the latch signal LOAD-P from the LOAD terminal and a signal HSYNC-N from an HSYNC terminal, forming correction data selecting signals for the first and second LED device groups, and supplying them to the multiplexer circuits MUX (A1) to MUX(D24), respectively.

The control circuit CTRL3 is a portion for receiving switching signals (ODD, EVEN) from a CPU (not shown) and allowing the cathode terminals (second electrodes) of the first LED device group and the second LED device group to be alternatively connected to the ground.

The total cell circuit MEM(T) is a circuit for receiving a predetermined signal from the flip-flop FFA25 when the correction value (correction data) is received and setting a value of a reference resistor Rref (not shown) every chip. Since this circuit is not directly necessary to describe the invention, its explanation is omitted here.

A schematic explanation of the whole construction of the driver IC including the memory cell circuits according to the embodiment has been made above. Details of the memory cell circuits according to the embodiment will be described hereinbelow.

Figure 2:
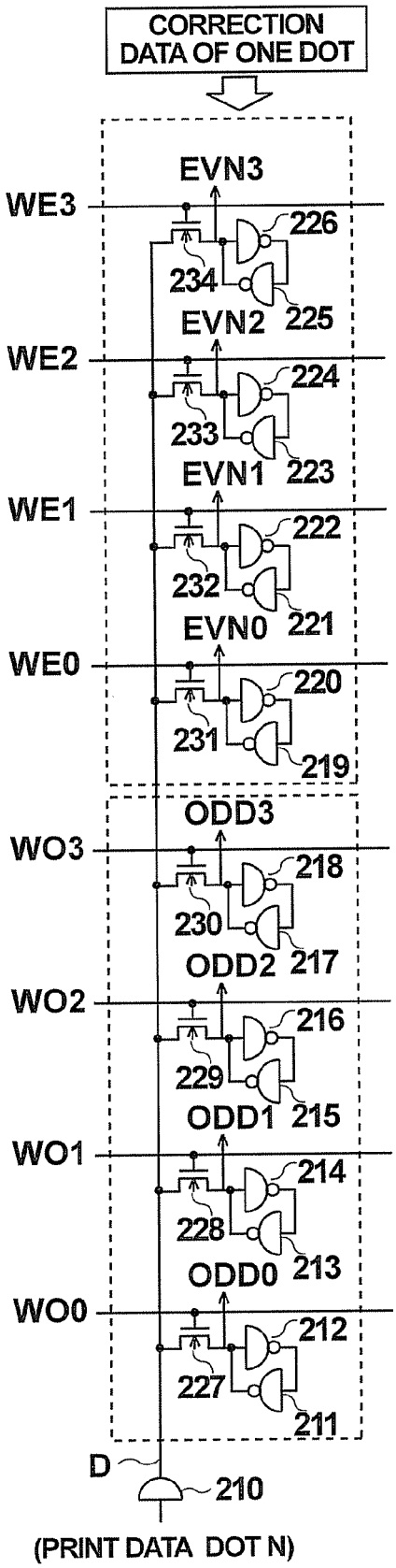
FIG. 2 is a circuit constructional diagram of a memory cell circuit in the embodiment 1.

FIG. 2 is a circuit constructional diagram of the memory cell circuit in the embodiment 1.

As shown in the diagram, the circuit constructed by two adjacent dot memories is illustrated and these dot memories are separately shown by regions surrounded by broken lines. For example, the correction value (correction data) is assumed to be 4-bit data and four memory cells are shown as a dot memory corresponding to one dot.

Explanation will be made hereinbelow by limiting to the case where the 192 LED devices D(1) to D(192) shown in FIG. 1 are arranged and connected to one LED driving circuit in layout order of those LED devices so that the adjacent LED devices form one pair and they are controlled. In this example, explanation will be made on the assumption that the anodes (first electrodes) of the adjacent LED devices are mutually connected, the cathodes (second electrodes) of the LED devices are alternately distributed in the layout order, the set of the odd-number designated LED devices is set to the first LED device group, and the set of the even-number designated LED devices is set to the second LED device group. Further, explanation will be made on the assumption that the dot memory group for storing the correction values corresponding to the first LED device group is set to the first dot memory group and the dot memory group for storing the correction values corresponding to the second LED device group is set to the second dot memory group. In the diagram, since a lower stage portion is a portion (dot memory belonging to the first dot memory group) for storing the correction data (correction values) of the odd-number designated dots, it is assumed to be the first dot memory. Since an upper stage portion is a portion (dot memory belonging to the second dot memory group) for storing the correction data (correction values) of the even-number designated dots, it is assumed to be the second dot memory.

The memory cell circuit MEM has a buffer 210, inverters 211 to 226, and n-channel MOS transistors 227 to 234. The memory cell circuit MEM has: a data line D; word lines WO0 to WO3 regarding the first dot memory; word lines WE0 to WE3 regarding the second dot memory; correction data output terminals ODD0 to ODD3 regarding the first dot memory; and correction data output terminals EVN0 to EVN3 regarding the second dot memory.

The data line D of the memory cell circuit MEM is connected to data output terminals Q of the flip-flops FFA1, FFB1, FFC1, FFD1, FFA2, . . . , FFA24, FFB24, FFC24, FFD24, and the like shown in FIG. 1 through the buffer 210, respectively. The data writing signals wo0, wo1, wo2, wo3, we0, we1, we2, and we3 from the control circuit CTRL1 (FIG. 1) are inputted to the word lines WO0, WO1, WO2, WO3, WE0, WE1, WE2, and WE3, respectively. The data line D is connected to first electrodes of the n-channel MOS transistors 227 to 234.

An input of the inverter 211 and an output of the inverter 212 are connected, thereby forming a memory cell. Similarly, an input of the inverter 213 and an output of the inverter 214 are connected, thereby forming a memory cell; an input of the inverter 215 and an output of the inverter 216 are connected, thereby forming a memory cell; an input of the inverter 217 and an output of the inverter 218 are connected, thereby forming a memory cell; an input of the inverter 219 and an output of the inverter 220 are connected, thereby forming a memory cell; an input of the inverter 221 and an output of the inverter 222 are connected, thereby forming a memory cell; an input of the inverter 223 and an output of the inverter 224 are connected, thereby forming a memory cell; and an input of the inverter 225 and an output of the inverter 226 are connected, thereby forming a memory cell. Second electrodes of the n-channel MOS transistors 227 to 234 are connected to input terminals of the inverters 212, 214, 216, 218, 220, 222, 224, and 226, respectively.

A gate electrode of the n-channel MOS transistor 227 is connected to the word line WO0. A gate electrode of the n-channel MOS transistor 228 is connected to the word line WO1. A gate electrode of the n-channel MOS transistor 229 is connected to the word line WO2. A gate electrode of the n-channel MOS transistor 230 is connected to the word line WO3. A gate electrode of the n-channel MOS transistor 231 is connected to the word line WE0. A gate electrode of the n-channel MOS transistor 232 is connected to the word line WE1. A gate electrode of the n-channel MOS transistor 233 is connected to the word line WE2. A gate electrode of the n-channel MOS transistor 234 is connected to the word line WE3.

An output of the inverter 211 is connected to the terminal ODD0. An output of the inverter 213 is connected to the terminal ODD1. An output of the inverter 215 is connected to the terminal ODD2. An output of the inverter 217 is connected to the terminal ODD3. An output of the inverter 219 is connected to the terminal EVN0. An output of the inverter 221 is connected to the terminal EVN1. An output of the inverter 223 is connected to the terminal EVN2. An output of the inverter 225 is connected to the terminal EVN3.

The correction data (4-bit data consisting of b0, b1, b2, and b3) per LED device (one dot) is stored into one dot memory (four memory cells) in the memory cell circuit MEM described above by the following procedure.

Step S1-1

The data of bit 3 in the correction data to be stored into the first dot memory is transferred to the shift register circuit (FIG. 1). Subsequently, when the word line WO3 is set to the H (high) level, the n-channel MOS transistor 230 is turned on and the data stored in the shift register circuit is written into the memory cell constructed by the inverters 218 and 217 through the buffer 210 and the data line D.

Step S1-2

The data of bit 3 in the correction data to be stored into the second dot memory is transferred to the shift register circuit (FIG. 1). Subsequently, when the word line WE3 is set to the H (high) level, the n-channel MOS transistor 234 is turned on and the data stored in the shift register circuit is written into the memory cell constructed by the inverters 226 and 225 through the buffer 210 and the data line D.

Step S1-3

The data of bit 2 in the correction data to be stored into the first dot memory is transferred to the shift register circuit (FIG. 1). Subsequently, when the word line WO2 is set to the H level, the n-channel MOS transistor 229 is turned on and the data stored in the shift register circuit is written into the memory cell constructed by the inverters 216 and 215 through the buffer 210 and the data line D.

Step S1-4

The data of bit 2 in the correction data to be stored into the second dot memory is transferred to the shift register circuit (FIG. 1). Subsequently, when the word line WE2 is set to the H (high) level, the n-channel MOS transistor 233 is turned on and the data stored in the shift register circuit is written into the memory cell constructed by the inverters 224 and 223 through the buffer 210 and the data line D.

Step S1-5

The data of bit 1 in the correction data to be stored into the first dot memory is transferred to the shift register circuit (FIG. 1). Subsequently, when the word line WO1 is set to the H level, the n-channel MOS transistor 228 is turned on and the data stored in the shift register circuit is written into the memory cell constructed by the inverters 214 and 213 through the buffer 210 and the data line D.

Step S1-6

The data of bit 1 in the correction data to be stored into the second dot memory is transferred to the shift register circuit (FIG. 1). Subsequently, when the word line WE1 is set to the H (high) level, the n-channel MOS transistor 232 is turned on and the data stored in the shift register circuit is written into the memory cell constructed by the inverters 222 and 221 through the buffer 210 and the data line D.

Step S1-7

The data of bit 0 in the correction data to be stored into the first dot memory is transferred to the shift register circuit (FIG. 1). Subsequently, when the word line WO0 is set to the H level, the n-channel MOS transistor 227 is turned on and the data stored in the shift register circuit is written into the memory cell constructed by the inverters 212 and 211 through the buffer 210 and the data line D.

Step S1-8

The data of bit 0 in the correction data to be stored into the second dot memory is transferred to the shift register circuit (FIG. 1). Subsequently, when the word line WE0 is set to the H (high) level, the n-channel MOS transistor 231 is turned on and the data stored in the shift register circuit is written into the memory cell constructed by the inverters 220 and 219 through the buffer 210 and the data line D.

In the above description, when an output of the buffer 210 is at the H level, an electric potential of the signal which is sent to the memory cell by turning on the n-channel MOS transistors 227 to 234 is smaller than that of the output of the buffer 210 by an amount of about a gate threshold voltage of the n-channel MOS transistors 227 to 234. Therefore, an input threshold voltage of the memory cell is set to be lower than that of the ordinary inverter in consideration of an H-level reduction that is caused by the gate threshold voltage of the n-channel MOS transistors 227 to 234.

As described above, in the memory cell circuit according to the embodiment, since the first dot memory and the second dot memory which form one pair are serially connected through one data line, the number of n-channel MOS transistors (path transistors) which are connected to the data line can be reduced into ½. Therefore, such an effect that an area of the IC chip is decreased and it is possible to contribute to reduction in costs of the LED head is obtained. The example in which the chip size is reduced by arranging one data line to the left side in the diagram has been shown and described here. However, in the memory cell circuit which has conventionally been well known, if a complementary data line is arranged to the right side in the diagram, it is necessary to arrange n-channel MOS transistors associated with another increased data line. Therefore, it becomes a limitation in the cost reduction.

Embodiment 2

Since the first dot memory and the second dot memory which form one pair are serially connected through one data line in the embodiment 1, the number of path transistors which are connected to the data line can be reduced. However, in the embodiment 1, since it is necessary to provide the word lines (WO0 to WO3, WE0 to WE3) every memory cell shown in FIG. 2, a large number of wirings are inevitably necessary and a large IC cap area to arrange them is occupied. To solve such a problem, in the embodiment 2, the word lines which are connected to the first dot memory and the second dot memory are constructed in common and selecting means for selecting either the first dot memory or the second dot memory is provided.

Figure 3:
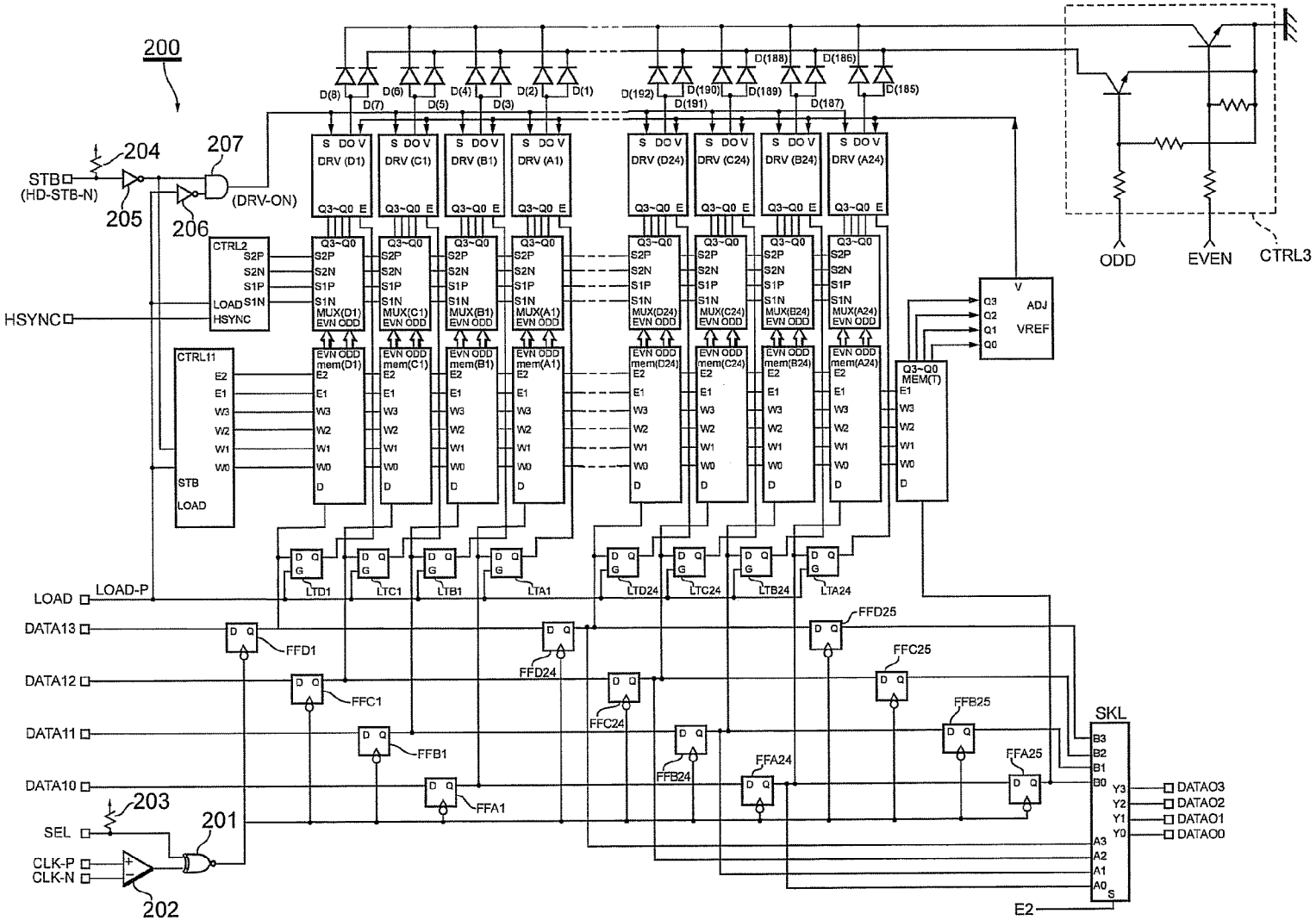
FIG. 3 is a block constructional diagram of a driver IC according to an embodiment 2.

FIG. 3 is a block constructional diagram of a driver IC according to the embodiment 2.

As shown in the diagram, a driver IC 200 in the embodiment 2 is realized merely by replacing the circuits in the driver IC 100 in the embodiment 1 as follows. That is, the control circuit CTRL1 is replaced by a control circuit CTRL11. The memory cell circuits MEM(A1) to MEM(A24) of the A group are replaced by memory cell circuits mem(A1) to mem(A24) of the A group. The memory cell circuits MEM(B1) to MEM (B24) of the B group are replaced by memory cell circuits mem(B1) to mem(B24) of the B group. The memory cell circuits MEM(C1) to MEM(C24) of the C group are replaced by memory cell circuits mem(C1) to mem(C24) of the C group. The memory cell circuits MEM(D1) to MEM(D24) of the D group are replaced by memory cell circuits mem(D1) to mem(D24) of the D group. Other portions are substantially similar to those of the driver IC 100 in the embodiment 1. Therefore, only the different portions will be described hereinbelow.

The control circuit CTRL11 is a circuit for receiving the latch signal LOAD-P from the LOAD terminal, receiving the strobe signal HD-STB-N through the inverter 205, and outputting the data writing signals (w0, w1, w2, w3) and data enable signals (e1, e2) to the memory cell circuits mem(A1) to mem(D24), respectively.

Figure 4:
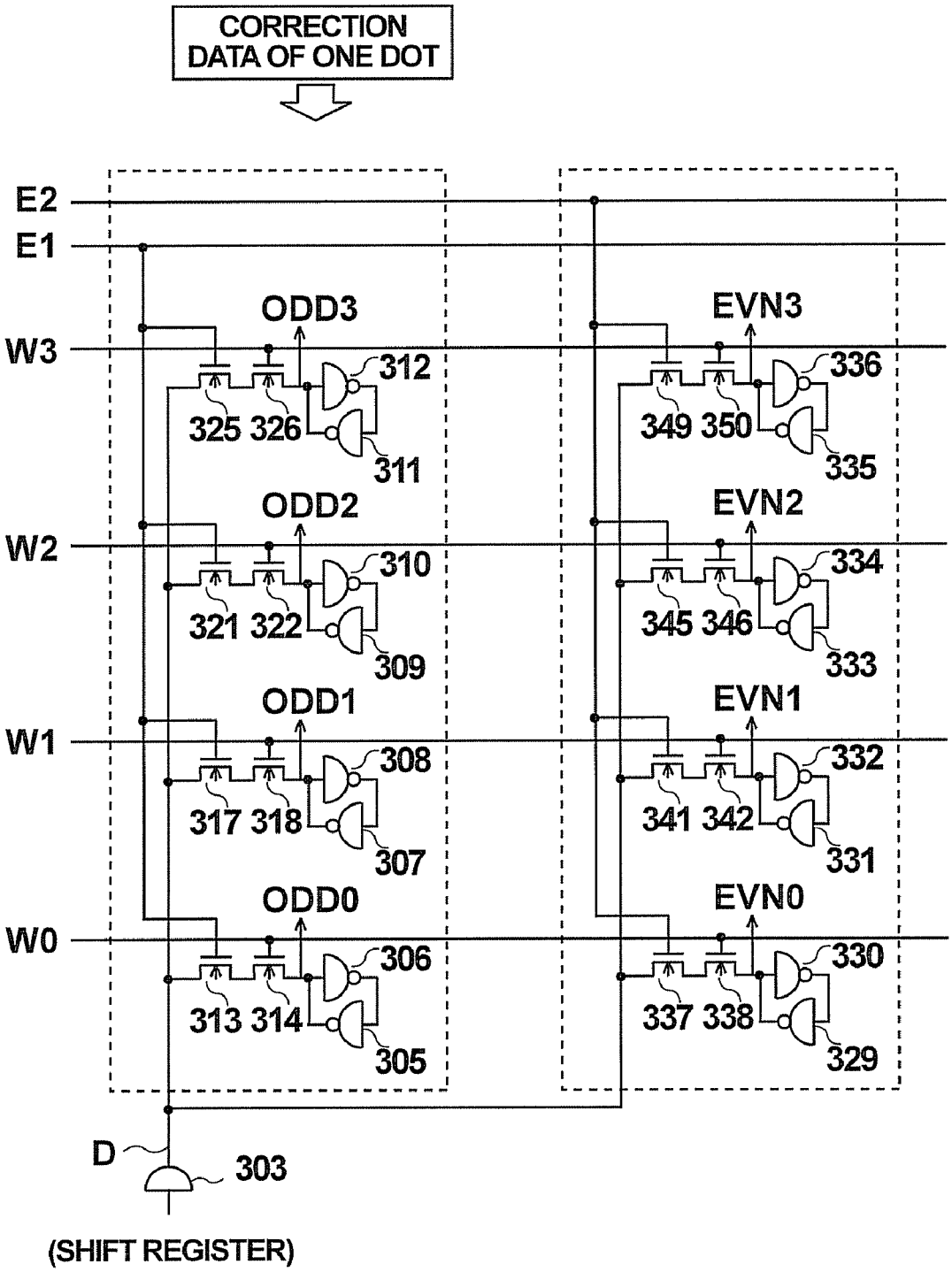
FIG. 4 is a circuit constructional diagram of a memory cell circuit in the embodiment 2.

FIG. 4 is a circuit constructional diagram of the memory cell circuit in the embodiment 2.

As shown in the diagram, the circuit constructed by two adjacent dot memories is illustrated and these dot memories are separately shown by regions surrounded by broken lines. For example, the correction value (correction data) is assumed to be 4-bit data and four memory cells are shown as a dot memory corresponding to one dot.

Explanation will be made hereinbelow by limiting to the case where the 192 LED devices D(1) to D(192) are arranged and connected to one LED driving circuit in layout order of those LED devices so that the adjacent LED devices are set to one pair and they are controlled. In this example, explanation will be made on the assumption that the anodes (first electrodes) of the adjacent LED devices are mutually connected, the cathodes (second electrodes) of the LED devices are alternately distributed in the layout order, the set of the odd-number designated LED devices is set to the first LED device group, and the set of the even-number designated LED devices is set to the second LED device group. Further, explanation will be made on the assumption that the dot memory group for storing the correction values corresponding to the first LED device group is set to the first dot memory group and the dot memory group for storing the correction values corresponding to the second LED device group is set to the second dot memory group. Explanation will be made on the assumption that since a left-side portion in the diagram is a portion (dot memory belonging to the first dot memory group) for storing the correction data (correction values) of the odd-number designated dots, it is assumed to be the first dot memory, and since a right-side portion is a portion (dot memory belonging to the second dot memory group) for storing the correction data (correction values) of the even-number designated dots, it is assumed to be the second dot memory.

The memory cell circuit mem has a buffer 303. The memory cell circuit mem also has inverters 305 to 312 and 329 to 336 and n-channel MOS transistors 313 to 326 and 337 to 350 constructing correction memory cells. The memory cell circuit mem has: the data line D; data signal enable lines E1 and E2 for receiving the data enable signal (e1, e2) from the control circuit CTRL11; the word lines W0 to W3; the correction data output terminals ODD0 to ODD3 regarding the odd-number designated dots (first dot memory); and the correction data output terminals EVN0 to EVN3 regarding the even-number designated dots (second dot memory).

The data line D of the memory cell circuit mem is connected to the data output terminals Q of the flip-flops FFA1, FFB1, FFC1, FFD1, FFA2, . . . , FFA24, FFB24, FFC24, FFD24, and the like shown in FIG. 3 through the buffer 303, respectively. The word lines W0, W1, W2, and W3 are connected to corresponding word terminals of the control circuit CTRL11 (FIG. 3). The data writing signals w0, w1, w2, and w3 are inputted to the word lines W0, W1, W2, and W3 from the control circuit CTRL11 (FIG. 3). The data enable signals (e1, e2) are inputted to the data signal enable lines E1 and E2 from the control circuit CTRL11 (FIG. 3), respectively. The data line D is connected to first electrodes of the n-channel MOS transistors 313, 317, 321, 325, 337, 341, 345, and 349, respectively.

An output of the inverter 306 and an input of the inverter 305 are connected, thereby forming a memory cell. Similarly, an output of the inverter 308 and an input of the inverter 307 are connected, thereby forming a memory cell. An output of the inverter 310 and an input of the inverter 309 are connected, thereby forming a memory cell. An output of the inverter 312 and an input of the inverter 311 are connected, thereby forming a memory cell. An output of the inverter 330 and an input of the inverter 329 are connected, thereby forming a memory cell. An output of the inverter 332 and an input of the inverter 331 are connected, thereby forming a memory cell. An output of the inverter 334 and an input of the inverter 333 are connected, thereby forming a memory cell. An output of the inverter 336 and an input of the inverter 335 are connected, thereby forming a memory cell. The n-channel MOS transistors 313 and 314 are serially connected. The n-channel MOS transistors 317 and 318 are serially connected. The n-channel MOS transistors 321 and 322 are serially connected. The n-channel MOS transistors 325 and 326 are serially connected. The n-channel MOS transistors 337 and 338 are serially connected. The n-channel MOS transistors 341 and 342 are serially connected. The n-channel MOS transistors 345 and 346 are serially connected. The n-channel MOS transistors 349 and 350 are serially connected. One end of each of the serial connections is connected to the data line D. The other ends of the serial connections are connected to inputs of the inverters 306, 308, 310, 312, 330, 332, 334, and 336, respectively.

Gate electrodes of the n-channel MOS transistors 314 and 338 are connected to the word line W0. Gate electrodes of the n-channel MOS transistors 318 and 342 are connected to the word line W1. Gate electrodes of the n-channel MOS transistors 322 and 346 are connected to the word line W2. Gate electrodes of the n-channel MOS transistors 326 and 350 are connected to the word line W3. The data signal enable line E1 is connected to gate electrodes of the n-channel MOS transistors 313, 317, 321, and 325. The data signal enable line E2 is connected to gate electrodes of the n-channel MOS transistors 337, 341, 345, and 349.

An output of the inverter 305 is connected to the terminal ODD0. An output of the inverter 307 is connected to the terminal ODD1. An output of the inverter 309 is connected to the terminal ODD2. An output of the inverter 311 is connected to the terminal ODD3. An output of the inverter 329 is connected to the terminal EVN0. An output of the inverter 331 is connected to the terminal EVN1. An output of the inverter 333 is connected to the terminal EVN2. An output of the inverter 335 is connected to the terminal EVN3.

The correction data (4-bit data consisting of b0, b1, b2, and b3) per LED device (one dot) is stored into one dot memory (four memory cells) in the memory cell circuit mem described above by the following procedure.

Step S2-1

The data of bit 3 in the correction data to be stored into the first dot memory (left side in FIG. 4) is transferred to the shift register circuit (FIG. 3). Subsequently, the data signal enable line E1 is set to the H (high) level, the data signal enable line E2 is set to the L (low) level, and the first dot memory (left side in FIG. 4) is selected. At this time, the n-channel MOS transistors 313, 317, 321, and 325 are turned on. Subsequently, the word line W3 is set to the H level. At this time, the n-channel MOS transistor 326 is turned on and the correction data stored in the shift register circuit is written into the memory cell constructed by the inverters 312 and 311 through the buffer 303 and the data line D.

Step S2-2

The data of bit 3 in the correction data to be stored into the second dot memory (right side in FIG. 4) is transferred to the shift register circuit (FIG. 3). Subsequently, the data signal enable line E2 is set to the H (high) level, the data signal enable line E1 is set to the L (low) level, and the second dot memory (right side in FIG. 4) is selected. At this time, the n-channel MOS transistors 337, 341, 345, and 349 are turned on. Subsequently, the word line W3 is set to the H level. At this time, the n-channel MOS transistor 350 is turned on and the correction data stored in the shift register circuit is written into the memory cell constructed by the inverters 336 and 335 through the buffer 303 and the data line D.

Step S2-3

The data of bit 2 in the correction data to be stored into the first dot memory (left side in FIG. 4) is transferred to the shift register circuit (FIG. 3). Subsequently, the data signal enable line E1 is set to the H level, the data signal enable line E2 is set to the L level, and the first dot memory (left side in FIG. 4) is selected. At this time, the n-channel MOS transistors 313, 317, 321, and 325 are turned on. Subsequently, the word line W2 is set to the H level. At this time, the n-channel MOS transistor 322 is turned on and the correction data stored in the shift register circuit is written into the memory cell constructed by the inverters 310 and 309 through the buffer 303 and the data line D.

Step S2-4

The data of bit 2 in the correction data to be stored into the second dot memory (right side in FIG. 4) is transferred to the shift register circuit (FIG. 3). Subsequently, the data signal enable line E2 is set to the H level, the data signal enable line E1 is set to the L level, and the second dot memory (right side in FIG. 4) is selected. At this time, the n-channel MOS transistors 337, 341, 345, and 349 are turned on. Subsequently, the word line W2 is set to the H level. At this time, the n-channel MOS transistor 346 is turned on and the correction data stored in the shift register circuit is written into the memory cell constructed by the inverters 334 and 333 through the buffer 303 and the data line D.

Step S2-5

The data of bit 1 in the correction data to be stored into the first dot memory (left side in FIG. 4) is transferred to the shift register circuit (FIG. 3). Subsequently, the data signal enable line E1 is set to the H level, the data signal enable line E2 is set to the L level, and the first dot memory (left side in FIG. 4) is selected. At this time, the n-channel MOS transistors 313, 317, 321, and 325 are turned on. Subsequently, the word line W1 is set to the H level. At this time, the n-channel MOS transistor 318 is turned on and the correction data stored in the shift register circuit is written into the memory cell constructed by the inverters 308 and 307 through the buffer 303 and the data line D.

Step S2-6

The data of bit 1 in the correction data to be stored into the second dot memory (right side in FIG. 4) is transferred to the shift register circuit (FIG. 3). Subsequently, the data signal enable line E2 is set to the H level, the data signal enable line E1 is set to the L level, and the second dot memory (right side in FIG. 4) is selected. At this time, the n-channel MOS transistors 337, 341, 345, and 349 are turned on. Subsequently, the word line W1 is set to the H level. At this time, the n-channel MOS transistor 342 is turned on and the correction data stored in the shift register circuit is written into the memory cell constructed by the inverters 332 and 331 through the buffer 303 and the data line D.

Step S2-7

The data of bit 0 in the correction data to be stored into the first dot memory (left side in FIG. 4) is transferred to the shift register circuit (FIG. 3). Subsequently, the data signal enable line E1 is set to the H level, the data signal enable line E2 is set to the L level, and the first dot memory (left side in FIG. 4) is selected. At this time, the n-channel MOS transistors 313, 317, 321, and 325 are turned on. Subsequently, the word line W0 is set to the H level. At this time, the n-channel MOS transistor 318 is turned on and the correction data stored in the shift register circuit is written into the memory cell constructed by the inverters 306 and 305 through the buffer 303 and the data line D.

Step S2-8

The data of bit 0 in the correction data to be stored into the second dot memory (right side in FIG. 4) is transferred to the shift register circuit (FIG. 3). Subsequently, the data signal enable line E2 is set to the H level, the data signal enable line E1 is set to the L level, and the second dot memory (right side in FIG. 4) is selected. At this time, the n-channel MOS transistors 337, 341, 345, and 349 are turned on. Subsequently, the word line W0 is set to the H level. At this time, the n-channel MOS transistor 338 is turned on and the correction data stored in the shift register circuit is written into the memory cell constructed by the inverters 330 and 329 through the buffer 303 and the data line D.

In the above description, when an output of the buffer 303 is at the H level, an electric potential of the signal which is sent to the memory cell by turning on the n-channel MOS transistors 313 and 314 is smaller than that of the output of the buffer 303 by an amount of about a gate threshold voltage of the n-channel MOS transistor 313 or 314. Therefore, an input threshold voltage of the inverter is set to be lower than that of the ordinary inverter in consideration of an H-level reduction that is caused by the gate threshold voltage of the n-channel MOS transistor (313 or 314).

As described above, in the memory cell circuit according to the embodiment, since the first dot memory and the second dot memory which form one pair are connected through one data line, the number of n-channel MOS transistors (path transistors) which are connected to the data line can be reduced in a manner similar to the embodiment 1. Further, since the word line is used in common by the first dot memory and the second dot memory, an occupied area of the wirings can be reduced. Therefore, such an effect that the IC chip area is decreased and it is possible to contribute to reduction in costs of the LED head is obtained. The case where one data line is arranged to the left side of the dot memory in the diagram has been shown and described here. However, even if a complementary data line is arranged to the right side of the dot memory in the diagram, a similar effect is obtained.

In the memory cell circuit shown in the embodiment, by providing the data signal enable lines, the word line can be used in common by the first dot memory and the second dot memory. Thus, the number of word lines can be remarkably reduced. Therefore, in addition to the effect in the embodiment 1, such an effect that the IC chip area can be decreased and it is possible to contribute to the cost reduction of the LED head is obtained.

Embodiment 3

In the multiplexer circuit which selects a correction value reading position (terminal for reading out the bit data) from the memory cell circuit, when the correction value reading positions are switched, in order to prevent the inversion of the memory storage data that is caused by the collision between the input data in the multiplexer circuit, the buffer circuit is provided at the input terminal of the multiplexer circuit. In the embodiment 3, the buffer circuit is deleted, data selecting signal generating means for supplying a data selecting signal to reading position data selecting means is provided, the data selecting signal generating means supplies the data selecting signal to reading position data selecting means, and timing for turning off all data selecting signals is provided between the data selecting signal and subsequent another data selecting signal. First, only the multiplexer circuit will be described hereinbelow. Subsequently, the data selecting signal generating means will be explained. Further, a connection between them will be described. Since a schematic construction of a whole driver IC including the multiplexer circuit MUX according to the embodiment 3 is substantially similar to that in the embodiment 1 or 2, its explanation is omitted here.

Figure 5:
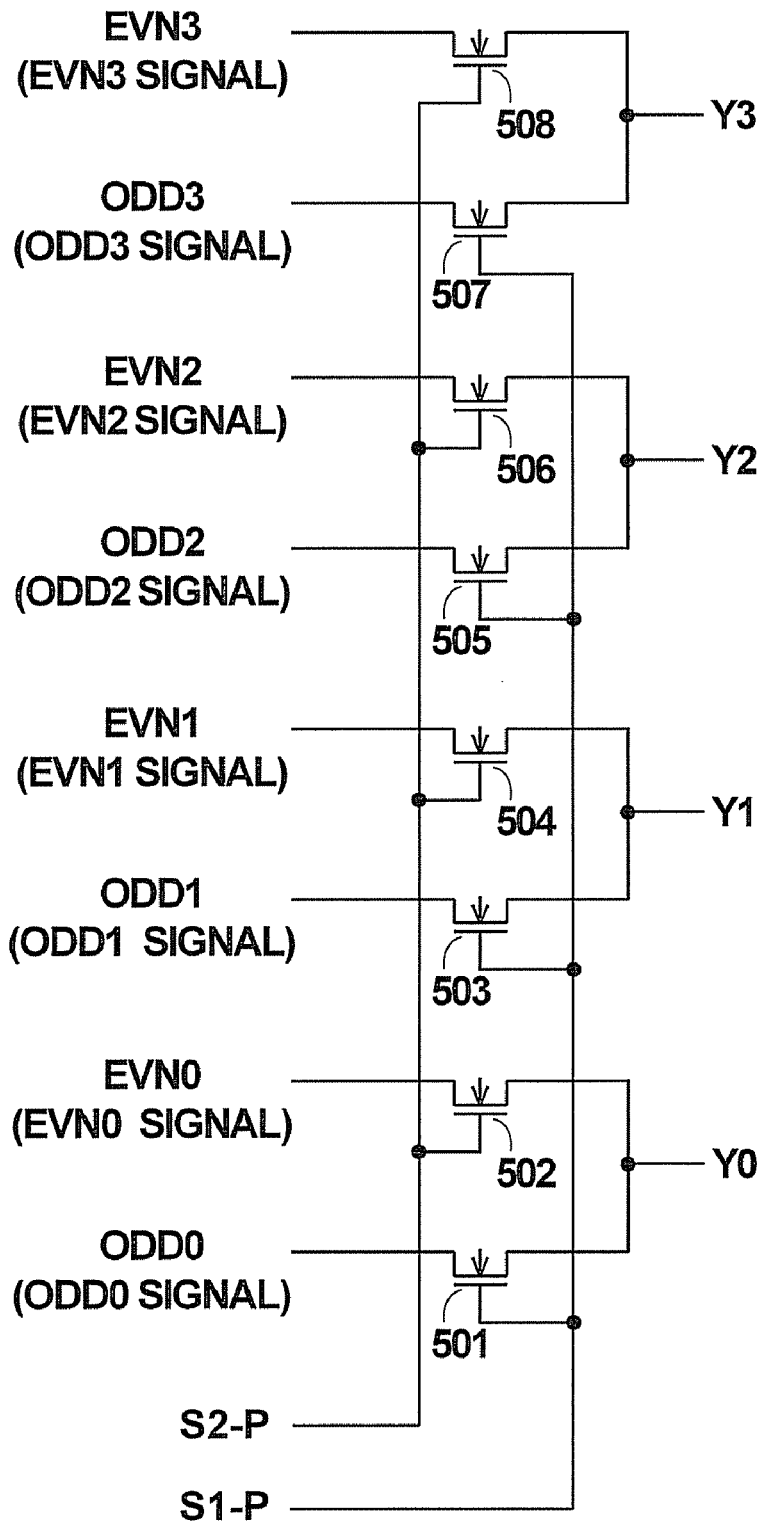
FIG. 5 is a circuit constructional diagram of a multiplexer circuit according to an embodiment 3.

FIG. 5 is a circuit constructional diagram of the multiplexer circuit according to the embodiment 3.

This multiplexer circuit corresponds to the multiplexer circuits MUX(A1) to MUX(A24), multiplexer circuits MUX (B1) to MUX(B24), multiplexer circuits MUX(C1) to MUX (C24), and multiplexer circuits MUX(D1) to MUX(D24) in FIG. 3. In the diagram, reference numerals 501 to 508 denote n-channel MOS transistors. A first electrode of the n-channel MOS transistor 501 is connected to the ODD0 terminal and a second electrode is connected to an output terminal Y0. A first electrode of the n-channel MOS transistor 503 is connected to the ODD1 terminal and a second electrode is connected to an output terminal Y1. A first electrode of the n-channel MOS transistor 505 is connected to the ODD2 terminal and a second electrode is connected to an output terminal Y2. A first electrode of the n-channel MOS transistor 507 is connected to the ODD3 terminal and a second electrode is connected to an output terminal Y3. A first electrode of the n-channel MOS transistor 502 is connected to the EVN0 terminal and a second electrode is connected to the output terminal Y0. A first electrode of the n-channel MOS transistor 504 is connected to the EVN1 terminal and a second electrode is connected to the output terminal Y1. A first electrode of the n-channel MOS transistor 506 is connected to the EVN2 terminal and a second electrode is connected to the output terminal Y2. A first electrode of the n-channel MOS transistor 508 is connected to the EVN3 terminal and a second electrode is connected to the output terminal Y3.

A data signal selecting line S1-P is connected to gate electrodes of the n-channel MOS transistors 501, 503, 505, and 507. A data signal selecting line S2-P is connected to gate electrodes of the n-channel MOS transistors 502, 504, 506, and 508. Now assuming that the data signal selecting line S1-P is at the H (high) level, the data signal selecting line S2-P is set to the L (low) level. Therefore, the n-channel MOS transistors 501, 503, 505, and 507 are ON and the n-channel MOS transistors 502, 504, 506, and 508 are turned off, respectively. At this time, an ODD0 signal inputted to the multiplexer circuit is outputted from the Y0 terminal through the n-channel MOS transistor 501 in the ON-state.

Also at the output terminals Y1 to Y3, the same logic values as those at the terminals ODD1 to ODD3 are outputted. As another case, when a signal of the data signal selecting line S2-P is at the H level, the S1-P signal is set to the L level. Therefore, the n-channel MOS transistors 502, 504, 506, and 508 are ON and the n-channel MOS transistors 501, 503, 505, and 507 are turned off, respectively. At this time, an EVN0 signal inputted to the multiplexer circuit is outputted from the Y0 terminal through the n-channel MOS transistor 502 in the ON-state. Also at the output terminals Y1 to Y3, the same logic values as those at the terminals EVN1 to EVN3 are outputted.

As mentioned above, in accordance with the logic values which are supplied to the data signal selecting lines S1-P and S2-P, either the ODD0 signal or the EVN0 signal is selected, either an ODD1 signal or an EVN1 signal is selected, either an ODD2 signal or an EVN2 signal is selected, either an ODD3 signal or an EVN3 signal is selected, and the selected signals are outputted from the output terminals Y0 to Y3, respectively.

Figure 6:
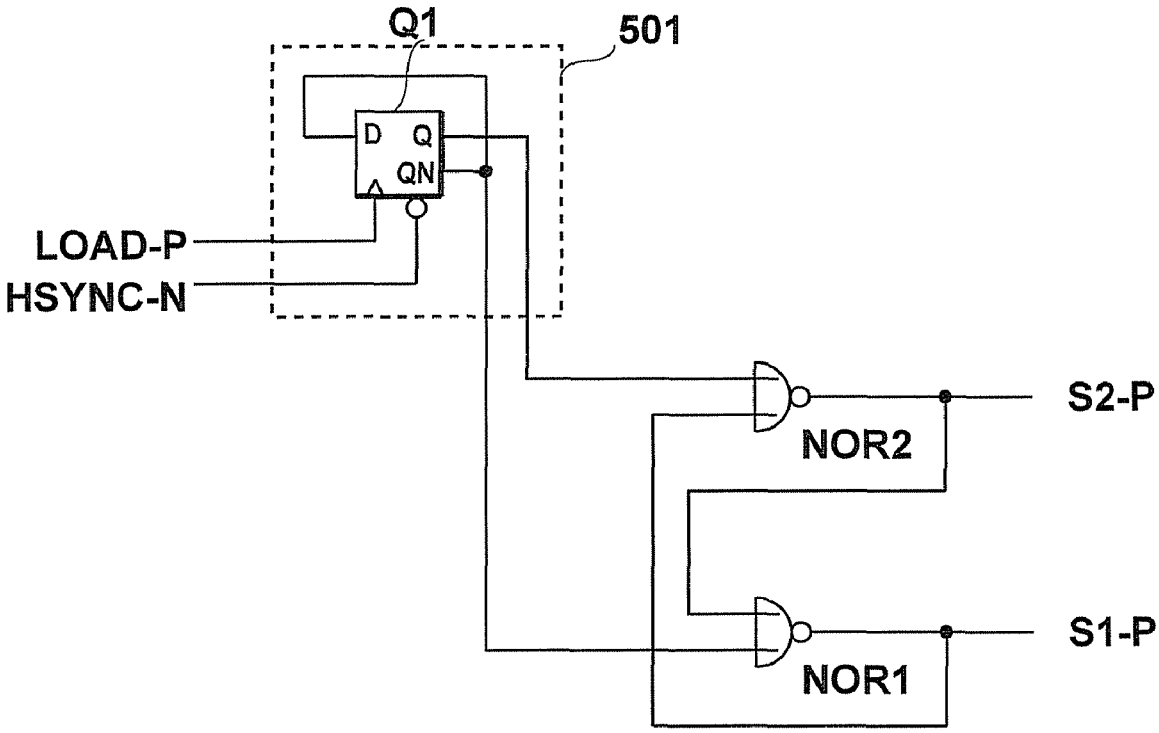
FIG. 6 is a circuit constructional diagram of switching signal generating means in the embodiment 3.

FIG. 6 is a circuit constructional diagram of switching signal generating means in the embodiment 3.

A circuit shown in the diagram is included in the control circuit CTRL2 (FIGS. 1 and 2). Reference numeral 501 denotes a toggle flip-flop and is constructed by connecting a D input of a flip-flop Q1 to a QN output. The LOAD-P signal as a latch signal is inputted to a clock input terminal of the flip-flop Q1 and the HSYNC-N signal as a sync signal of the head, which will be explained hereinafter, is inputted to a reset terminal of the flip-flop Q1.

NOR1 and NOR2 denote NOR gates. One input terminal of the NOR gate NOR2 is connected to a Q output of the flip-flop Q1 and the other input terminal is connected to an output of the NOR gate NOR1. One input terminal of the NOR gate NOR1 is connected to an output terminal of the NOR gate NOR2 and the other input terminal is connected to the QN output of the flip-flop Q1. The outputs of the NOR gates NOR2 and NOR1 are connected to the data signal selecting lines S2-P and S1-P (FIG. 5).

Figure 7:
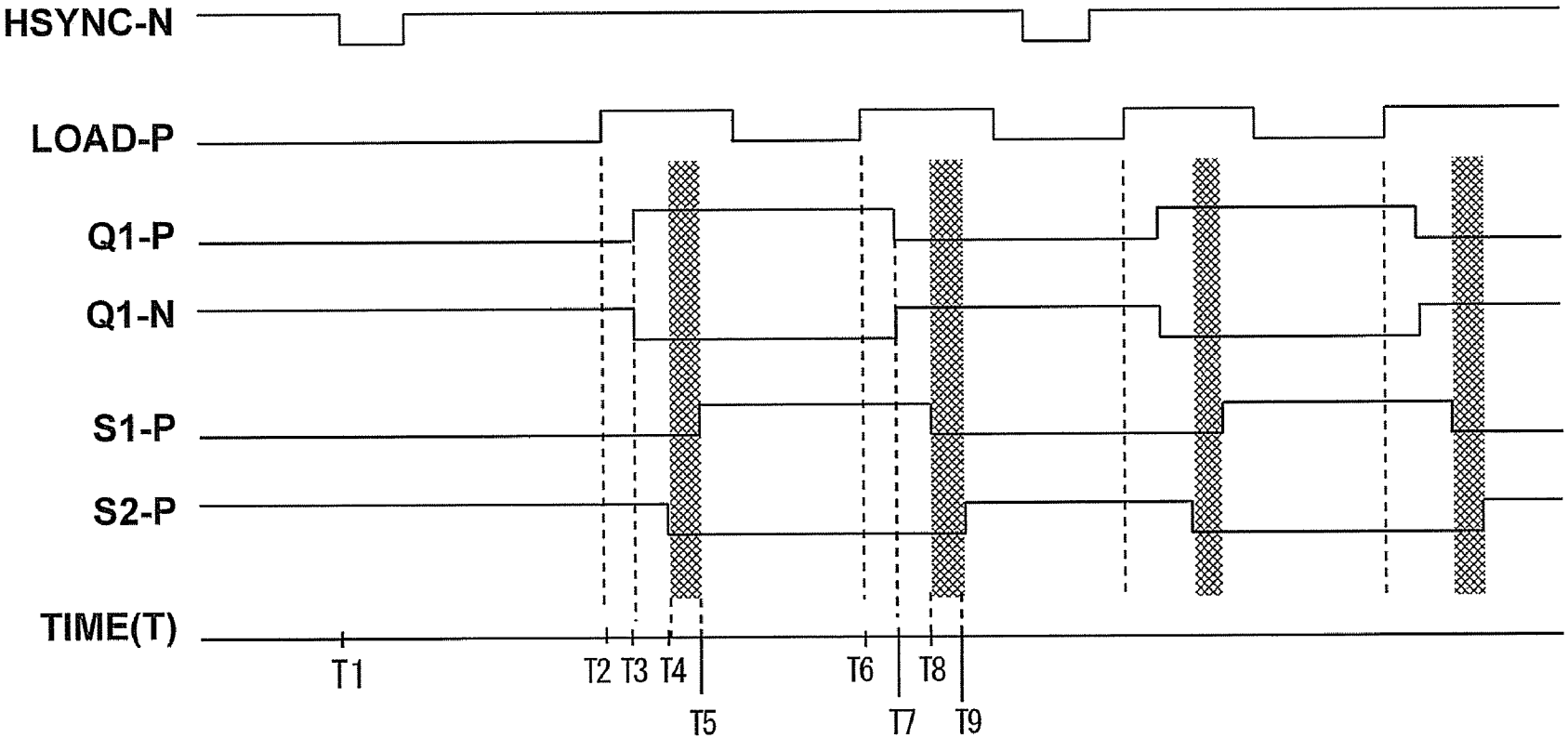
FIG. 7 is a time chart for explaining the operation of a control circuit in the embodiment 3.

FIG. 7 is a time chart for explaining the operation of the control circuit in the embodiment 3.

In the diagram, in order from the top, signal waveforms show the HSYNC-N signal, the LOAD-P signal, a state Q1-P of the Q output terminal, a state Q1-N of the QN terminal, a state of the data signal selecting line S1-P, a state of the data signal selecting line S2-P, and time which is common to those signals.

Time T1

The control circuit CTRL2 (FIGS. 1 and 2) receives a negative polarity pulse of the HSYNC-N signal, the flip-flop Q1 is initialized, a Q1-P signal is set to the L level, and a Q1-N signal is set to the H level.

Time T2

Subsequently, the transferring process of the odd-number designated dot data (not shown) is completed. The control circuit CTRL2 (FIGS. 1 and 2) receives the latch signal LOAD-P.

Time T3

Thus, a logic value of the flip-flop Q1 is inverted, the Q1-P signal is set to the H level, and the Q1-N signal is set to the L level.

Time T4

The output of the NOR gate NOR2 is connected to the input of the NOR gate NOR1 (FIG. 6). The output of the NOR gate NOR1 is connected to the input of the NOR gate NOR2 (FIG. 6). Therefore, an influence by the above signal transition first appears in the data signal selecting line S2-P. The data signal selecting line S2-P is shifted from the H level to the L level.

Time T5

After that, the data signal selecting line S1-P is shifted from the L level to the H level.

Time T6

Subsequently, the transferring process of the even-number designated dot data (not shown) is completed. The control circuit CTRL2 (FIGS. 1 and 2) receives the latch signal LOAD-P.

Time T7

The logic value of the flip-flop Q1 is inverted, the Q1-P signal changes from the H level to the L level and the Q1-N signal changes from the L level to the H level.

Time T8

In association with the above state change, first, the data signal selecting line S1-P is shifted from the H level to the L level.

Time T9

After that, the data signal selecting line S2-P is shifted from the L level to the H level.

After that, the similar operation is repeated. It should be noted to the following point. In the circuit shown in FIG. 6, the output of the NOR gate NOR2 is connected to the input of the NOR gate NOR1 and the output of the NOR gate NOR1 is connected to the input of the NOR gate NOR2. Therefore, a clear order relation has been given to the signal transfer. Thus, a period of time during which both of the data signal selecting line S1-P and the data signal selecting line S2-P are turned off occurs in the hatched portions (T4 to T5 and T8 to T9) in the diagram.

Figure 8:
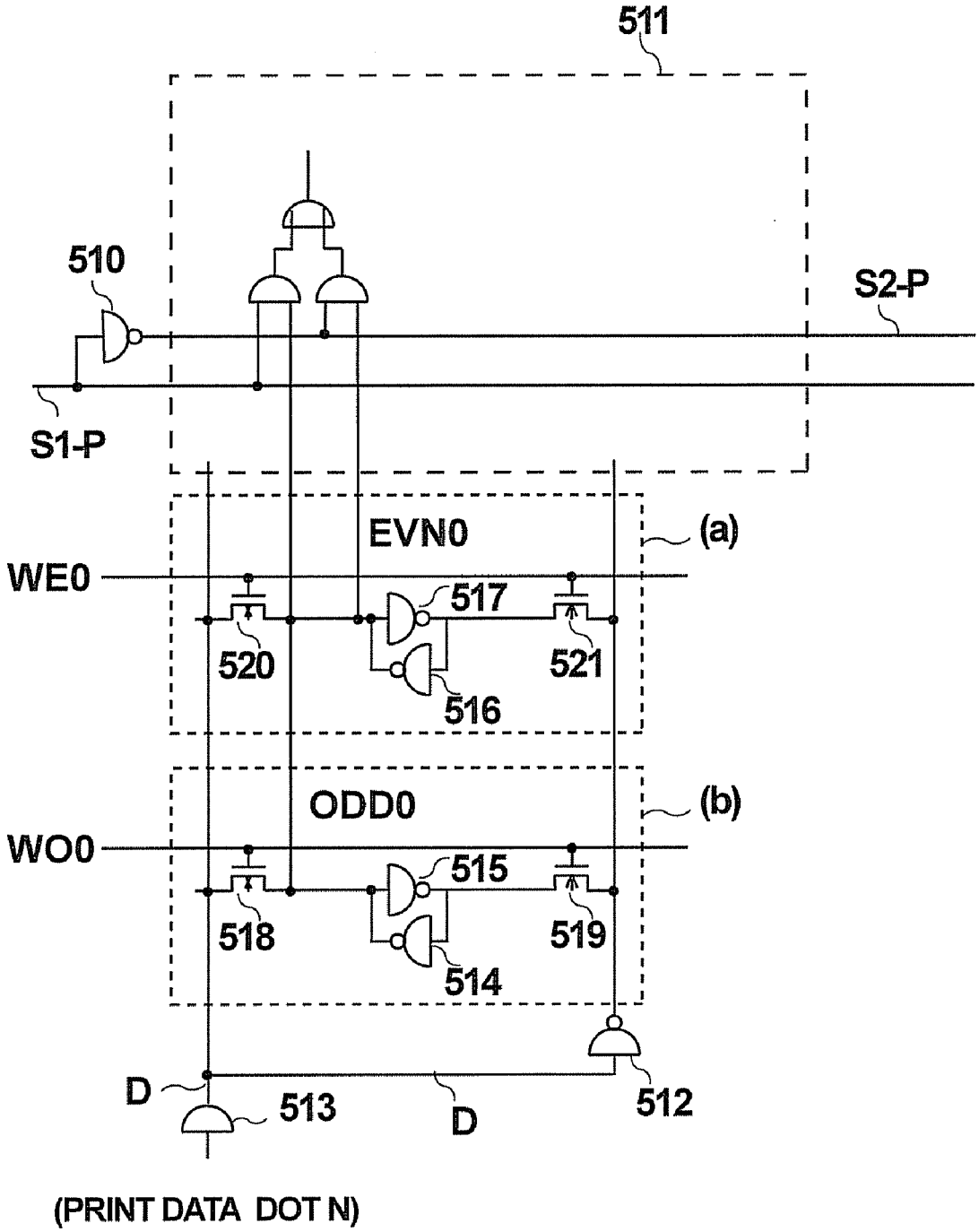
FIG. 8 shows a connection comparison example of the multiplexer circuit and the memory cell circuits.

FIG. 8 shows a connection comparison example of the multiplexer circuit and the memory cell circuits.

This diagram shows the connection example of the multiplexer circuit and the memory cell circuits in the related art.

In the diagram, reference numeral 513 denotes a buffer; 512, 514 to 517, and 510 inverters; 518 to 521 n-channel MOS transistors; and 511 a multiplexer circuit comprising AND gates and an OR gate in the related art.

Hatched portions (a) and (b) indicate the memory cell circuits. In the diagram, only ODD0 and EVN0 in the correction data of the odd-number designated dots and the even-number designated dots are shown. As will be understood from the diagram, an input of the inverter 510 is directly connected to the data signal selecting line S1-P and an output is directly connected to the data signal selecting line S2-P. Therefore, in the signal transition steps of the data signal selecting line S1-P and the data signal selecting line S2-P, a moment when the data signal selecting line S1-P and the data signal selecting line S2-P are simultaneously turned on can occur. Thus, a case where the data between the memory cells collides also can occur. To avoid such a problem, a period of time during which all of a plurality of data signal selecting lines are turned off is provided, only the data of one of them is selected upon signal transition of the data signal selecting lines, and the collision of a plurality of data in the multiplexer circuit does not occur.

In the embodiment, the data selecting signal generating means as shown in FIG. 5 is provided in the control circuit CTRL2 (FIGS. 1 and 2), the multiplexer circuit shown in FIG. 5 is used in place of the multiplexer circuit 511 in FIG. 8, and the switching signal generating means shown in FIG. 6 is used. Thus, the timing when both of the data signal selecting lines are turned off can be successfully inserted in the middle of the ON-timing for switching the correction data of the odd-number designated dots and the correction data of the even-number designated dots. Therefore, upon transition of the data selecting signals, the odd-number designated dot correction data and the even-number designated dot correction data do not collide. Such an effect that many multiplexer circuits which are used are simply constructed as shown in FIG. 5 and it is possible to largely contribute to the cost reduction of the LED head is obtained.

Embodiment 4

In this embodiment, a multiplexer circuit different from that of the embodiment 3 is constructed.

Figure 9:
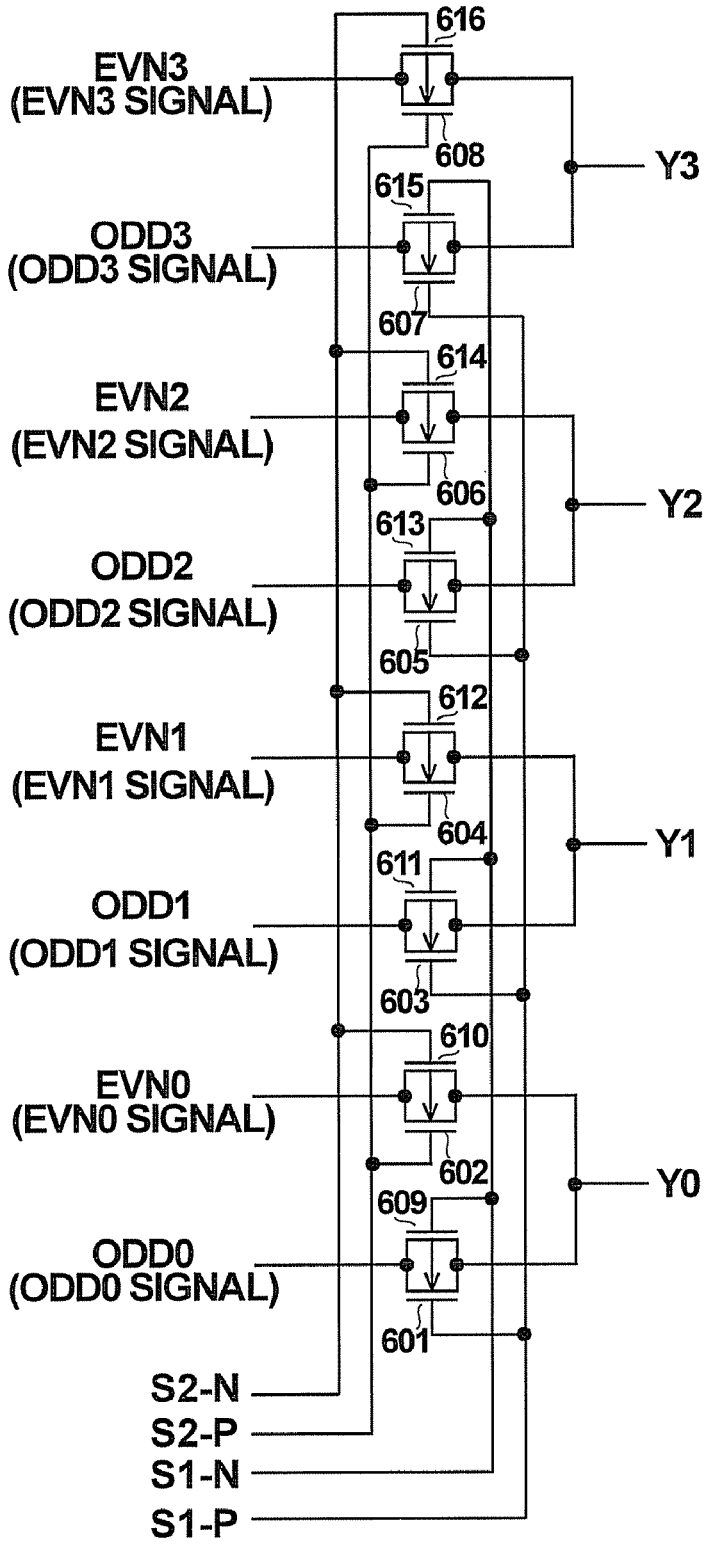
FIG. 9 is a circuit constructional diagram of a multiplexer circuit according to an embodiment 4.

FIG. 9 is a constructional diagram of the multiplexer circuit according to the embodiment 4.

In the diagram, reference numerals 601 to 608 denote n-channel MOS transistors and 609 to 616 denote p-channel MOS transistors. First electrodes of the n-channel MOS transistor 601 and the p-channel MOS transistor 609 are connected, second electrodes of the n-channel MOS transistor 601 and the p-channel MOS transistor 609 are connected, and a transmission gate circuit is constructed by both of them.

First electrodes of the n-channel MOS transistor 602 and the p-channel MOS transistor 610 are connected, second electrodes of the n-channel MOS transistor 602 and the p-channel MOS transistor 610 are connected, and a transmission gate circuit is constructed by both of them. First electrodes of the n-channel MOS transistor 603 and the p-channel MOS transistor 611 are connected, second electrodes of the n-channel MOS transistor 603 and the p-channel MOS transistor 611 are connected, and a transmission gate circuit is constructed by both of them. First electrodes of the n-channel MOS transistor 604 and the p-channel MOS transistor 612 are connected, second electrodes of the n-channel MOS transistor 604 and the p-channel MOS transistor 612 are connected, and a transmission gate circuit is constructed by both of them.

First electrodes of the n-channel MOS transistor 605 and the p-channel MOS transistor 613 are connected, second electrodes of the n-channel MOS transistor 605 and the p-channel MOS transistor 613 are connected, and a transmission gate circuit is constructed by both of them. First electrodes of the n-channel MOS transistor 606 and the p-channel MOS transistor 614 are connected, second electrodes of the n-channel MOS transistor 606 and the p-channel MOS transistor 614 are connected, and a transmission gate circuit is constructed by both of them. First electrodes of the n-channel MOS transistor 607 and the p-channel MOS transistor 615 are connected, second electrodes of the n-channel MOS transistor 607 and the p-channel MOS transistor 615 are connected, and a transmission gate circuit is constructed by both of them. First electrodes of the n-channel MOS transistor 608 and the p-channel MOS transistor 616 are connected, second electrodes of the n-channel MOS transistor 608 and the p-channel MOS transistor 616 are connected, and a transmission gate circuit is constructed by both of them.

First electrodes of the n-channel MOS transistor 601 and the p-channel MOS transistor 609 are connected to the ODD0 terminal and their second electrodes are connected to the output terminal Y0. The first electrodes of the n-channel MOS transistor 602 and the p-channel MOS transistor 610 are connected to the EVN0 terminal and their second electrodes are connected to the output terminal Y0.

The first electrodes of the n-channel MOS transistor 603 and the p-channel MOS transistor 611 are connected to the ODD1 terminal and their second electrodes are connected to the output terminal Y1. The first electrodes of the n-channel MOS transistor 604 and the p-channel MOS transistor 612 are connected to the EVN1 terminal and their second electrodes are connected to the output terminal Y1.

The first electrodes of the n-channel MOS transistor 605 and the p-channel MOS transistor 613 are connected to the ODD2 terminal and their second electrodes are connected to the output terminal Y2. The first electrodes of the n-channel MOS transistor 606 and the p-channel MOS transistor 614 are connected to the EVN2 terminal and their second electrodes are connected to the output terminal Y2.

The first electrodes of the n-channel MOS transistor 607 and the p-channel MOS transistor 615 are connected to the ODD3 terminal and their second electrodes are connected to the output terminal Y3. The first electrodes of the n-channel MOS transistor 608 and the p-channel MOS transistor 616 are connected to the EVN3 terminal and their second electrodes are connected to the output terminal Y3.

The data signal selecting line S1-P is connected to gate electrodes of the n-channel MOS transistors 601, 603, 605, and 607. A data signal selecting line S1-N is connected to gate electrodes of the p-channel MOS transistors 609, 611, 613, and 615. The data signal selecting line S2-P is connected to gate electrodes of the n-channel MOS transistors 602, 604, 606, and 608. A data signal selecting line S2-N is connected to gate electrodes of the p-channel MOS transistors 610, 612, 614, and 616.

Now assuming that the data signal selecting line S1-P is at the H level and the data signal selecting line S0-N is at the L level, the data signal selecting line S2-P is set to the L level and the data signal selecting line S2-N is set to the H level. Therefore, the n-channel MOS transistors 601, 603, 605, and 607 and the p-channel MOS transistors 609, 611, 613, and 615 are ON and the n-channel MOS transistors 602, 604, 606, and 608 and the p-channel MOS transistors 610, 612, 614, and 616 are turned off, respectively.

At this time, the ODD0 signal inputted to the multiplexer circuit is outputted from the Y0 terminal through the n-channel MOS transistor 601 and the p-channel MOS transistor 609 in the ON-state. Also at the output terminals Y1 to Y3, the same logic values as those at the terminals ODD1 to ODD3 are outputted. As another case, when the data signal selecting line S2-P is at the H level and the data signal selecting line S2-N is at the L level, the data signal selecting line S1-P is set to the L level and the data signal selecting line S1-N is set to the H level. Therefore, the n-channel MOS transistors 602, 604, 606, and 608 and the p-channel MOS transistors 610, 612, 614, and 616 are ON and the n-channel MOS transistors 601, 603, 605, and 607 and the p-channel MOS transistors 609, 611, 613, and 615 are turned off, respectively.

At this time, the EVN0 signal inputted to the multiplexer circuit is outputted from the output terminal Y0 through the n-channel MOS transistor 602 and the p-channel MOS transistor 610 in the ON-state. Also at the output terminals Y1 to Y3, the same logic values as those at the terminals EVN1 to EVN3 are outputted. As mentioned above, in accordance with the logic values of the data signal selecting lines S1-P, S1-N, S2-P, and S2-N, either the ODD0 signal or the EVN0 signal is selected, either the ODD1 signal or the EVN1 signal is selected, either the ODD2 signal or the EVN2 signal is selected, either the ODD3 signal or the EVN3 signal is selected, and the selected signals are outputted from the output terminals Y0 to Y3, respectively.

Figure 10:
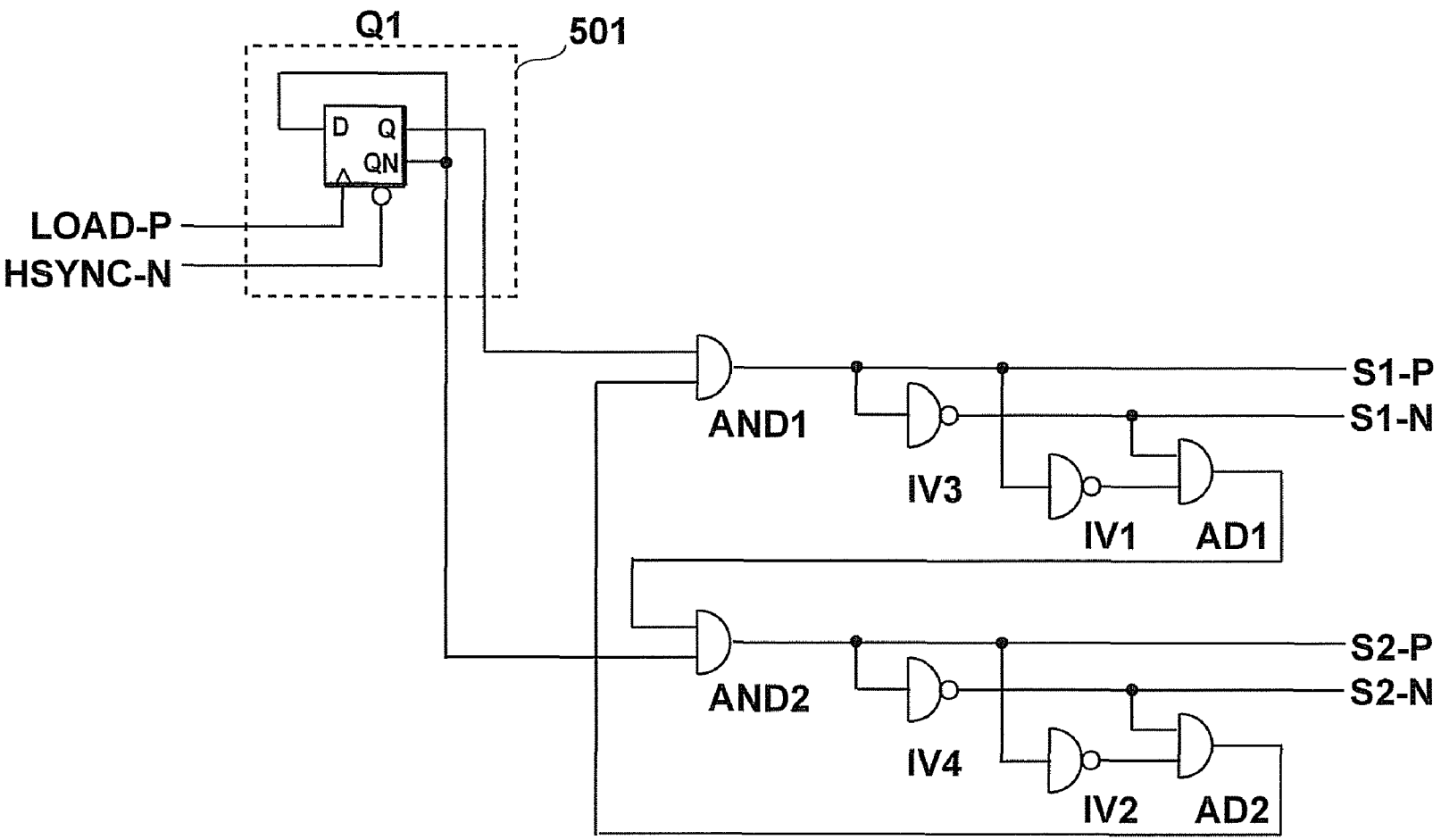
FIG. 10 is a circuit constructional diagram of data signal generating means in the embodiment 4.

FIG. 10 is a circuit constructional diagram of the switching signal generating means in the embodiment 4.

The toggle flip-flop 501 is constructed by connecting the D input of the flip-flop Q1 to the QN output. The latch signal LOAD-P is inputted to the clock input terminal of the flip-flop Q1 and the sync signal HSYNC-N of the head is inputted to the reset terminal of the flip-flop Q1.

AND1, AND2, AD1, and AD2 denote AND gates. IV1 to IV4 denote inverters. One input terminal of the AND gate AND1 is connected to the Q output of the flip-flop Q1 and the other input terminal is connected to an output of the buffer AD2. One input terminal of the AND gate AND2 is connected to an output terminal of the buffer AD1 and the other input terminal is connected to the QN output of the flip-flop Q1. An input of the inverter IV3 is connected to an output of the AND gate AND1. An input of the inverter IV4 is connected to an output of the AND gate AND2. The output of the AND gate AND1 is connected to the data signal selecting line S1-P. The output of the AND gate AND2 is connected to the data signal selecting line S2-P. An output of the inverter IV3 is connected to the data signal selecting line S1-N. An output of the inverter IV4 is connected to the data signal selecting line S2-N. An input of the inverter IV1 is connected to the output of the AND gate AND1. An input of the inverter IV2 is connected to the output of the AND gate AND2. One input of the buffer AD1 is connected to the output of the inverter IV3 and the other input is connected to an output of the inverter IV1. One input of the buffer AD2 is connected to the output of the inverter IV4 and the other input is connected to an output of the inverter IV2.

Figure 11:
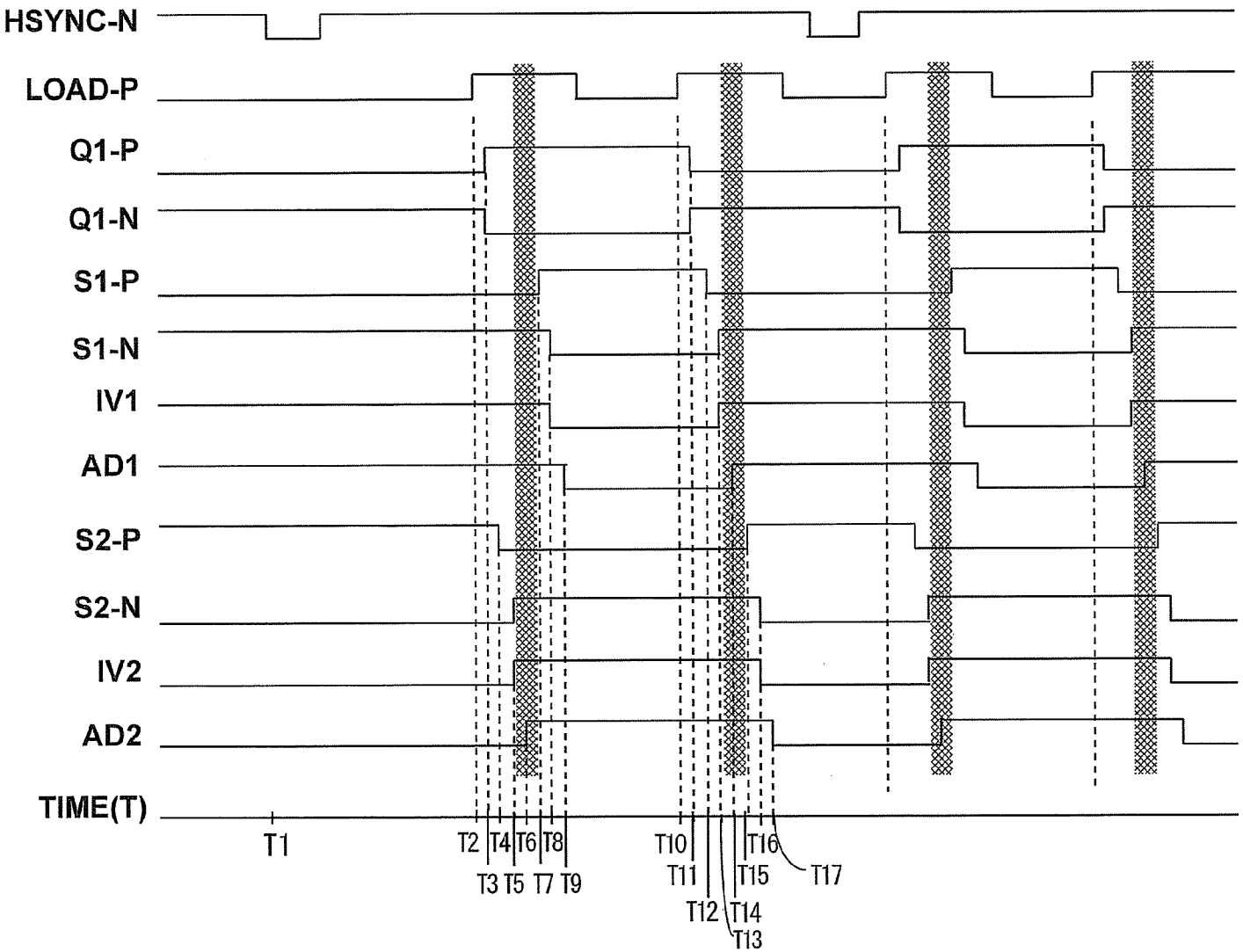
FIG. 11 is a time chart showing the operation of a control circuit in the embodiment 4.

FIG. 11 is a time chart showing the operation of the control circuit in the embodiment 4.

In the diagram, in order from the top, signal waveforms show the HSYNC-N signal, the LOAD-P signal, the state Q1-P of the Q output terminal, the state Q1-N of the QN terminal, the state of the data signal selecting line S1-P, a state of the data signal selecting line S1-N, a state of the inverter IV1, a state of the buffer AD1, the state of the data signal selecting line S2-P, a state of the data signal selecting line S2-N, a state of the inverter IV2, a state of the buffer AD2, and time which is common to those signals.

Time T1

The control circuit CTRL2 (FIGS. 1 and 2) receives a negative polarity pulse of the HSYNC-N signal, the flip-flop Q1 is initialized, the Q1-P signal is set to the L level, and the Q1-N signal is set to the H level.

Time T2

Subsequently, the transferring process of the odd-number designated dot data (not shown) is completed. The control circuit CTRL2 (FIGS. 1 and 2) receives the latch signal LOAD-P.

Time T3

Thus, the logic value of the flip-flop Q1 is inverted, the Q1-P signal is set to the H level, and the Q1-N signal is set to the L level.

Time T4

The output of the buffer AD2 is connected to the input of the AND gate AND1 and the output of the buffer AD1 is connected to the input of the AND gate AND2 (FIG. 10). Therefore, the influence by the above signal transition appears first in the data signal selecting line S2-P. The output of the AND gate AND2, that is, the data signal selecting line S2-P is shifted from the H level to the L level.

Time T5

Subsequently, the data signal selecting line S2-N as an output of the inverter IV4 also rises from the L level to the H level. The output of the inverter IV2 also rises at similar timing.

Time T6

Since the output of the inverter IV2 is transmitted to the buffer AD2, the output of the buffer AD2 is shifted from the L level to the H level after the data signal selecting line S2-N was set to the H level or the L level or after the elapse of a short delay time after the data signal selecting line S2-N had been set to the H level or the L level.

Time T7

Since one input of the AND gate AND1 connected to Q is at the H level and the output of the buffer AD2 as another input signal of the AND gate AND1 rises, the output of the AND gate AND1 rises. The data signal selecting line S1-P changes from the L level to the H level.

Time T8

Subsequently, the logic value of the flip-flop Q1 is inverted by the inverter IV3 and the data signal selecting line S1-N changes from the H level to the L level. The output of the inverter IV1 also trails at timing similar to that mentioned above and is transmitted to one input of the buffer AD1.

Time T9

The other input of the buffer AD1 is connected to the data signal selecting line S1-N. When the data signal selecting line S1-N is set to the L level or the output of the inverter IV1 is set to the L level, the buffer AD1 is also set to the L level after the elapse of a short delay time. Since the signal passes through such a signal transfer path, such a sequence that after the data signal selecting line S2-P trailed, the data signal selecting line S2-N rises, and after the data signal selecting line S1-P rose, the data signal selecting line S1-N trails is obtained.

Time T10

Subsequently, the transferring process of the even-number designated dot data (not shown) is completed. The second latch signal (LOAD-P) is inputted.

Time T11

The logic value of Q1 is inverted, the Q1-P signal changes from the H level to the L level, and the Q1-N signal changes from the L level to the H level.

Time T12

In association with the above state change, first, the data signal selecting line S1-P trails from the H level to the L level.

Time T13

Subsequently, the data signal selecting line S1-N rises from the L level to the H level. The output of the inverter IV1 also rises at timing similar to that mentioned above.

Time T14

Since the above change is propagated to the buffer AD1, the output of the buffer AD1 is shifted from the L level to the H level after the elapse of a short delay time.

Time T15

Since one input of the AND gate AND2 connected to Q1 is at the H level and the output of the buffer AD1 as another input signal of the AND gate AND2 rises, the output of the AND gate AND2 rises. The data signal selecting line S2-P changes from the L level to the H level.

Time T16

Subsequently, the logic value of the flip-flop Q1 is inverted by the inverter IV2 and the data signal selecting line S2-N trails from the H level to the L level. The output of the inverter IV2 also trails at timing similar to that mentioned above and is transmitted to one input of the buffer AD2.

Time T17

The other input of the buffer AD2 is connected to the data signal selecting line S2-N. When the data signal selecting line S2-N is set to the L level or the output of the inverter IV2 is set to the L level, the buffer AD2 is also set to the L level. After that, the similar operation is repeated.

Since the signal passes through such a signal transfer path, such a sequence that after the data signal selecting line S1-P trailed, the data signal selecting line S1-N rises, and after the data signal selecting line S2-P rose, the data signal selecting line S2-N trails is obtained. Thus, a period of time during which all of the data signal selecting lines S1-P, S2-P, S1-N, and S2-N are set to the L level occurs between time T5 and T7 and between time T13 and T15.

As shown in FIG. 10, the output of the AND gate AND1 is connected to the input of the AND gate AND2 through the buffer AD1. The output of the AND gate AND2 is connected to the input of the AND gate AND1 through the buffer AD2. A clear order relation has been given to the signal transfer. Therefore, such an order relation of the signal transition that after the data signal selecting line S2-P trailed, the data signal selecting line S2-N rises, subsequently, the data signal selecting line S1-P rises, and the data signal selecting line S1-N trails is held. Also such an order relation of the signal transition that after the data signal selecting line S1-P trailed, the data signal selecting line S1-N rises, subsequently, the data signal selecting line S2-P rises, and the data signal selecting line S2-N trails is held.

As described above, by combining the switching signal generating means shown in FIG. 10 with the multiplexer circuit shown in FIG. 9, the timing when both of the data signal selecting lines are turned off can be inserted in the middle of the ON-timing for switching the correction data of the odd-number designated dots and the correction data of the even-number designated dots. Therefore, the odd-number designated dot correction data and the even-number designated dot correction data do not collide. Thus, such a technique which has been performed in the related art that the buffer is interposed between the memory cell output and the multiplexer data input in order to prevent the inversion of the data in the memory cell becomes unnecessary. Consequently, such an effect that it is possible to contribute to the cost reduction of the LED head is obtained.

Embodiment 5

The above embodiments 1 to 4 have been described by limiting to the case where, as shown in FIG. 1 or 3, the 192 LED devices D(1) to D(192) are arranged and connected to one LED driving circuit in layout order of those LED devices so that the adjacent LED devices form one pair and they are controlled. In the embodiment 5, it is assumed that the 192 LED devices D(1) to D(192) are arranged and connected to one LED driving circuit in layout order of those LED devices so that the four LED devices form one set and they are controlled. In this instance, explanation will be made on the assumption that the anodes (first electrodes) of one set of four LED devices are mutually connected, the cathodes (second electrodes) of the LED devices are alternately distributed in the layout order, the first set of the LED devices is set to the first LED device group, the second set of the LED devices is set to the second LED device group, the third set of the LED devices is set to the third LED device group, and the fourth set of the LED devices is set to the fourth LED device group.

Figure 12:
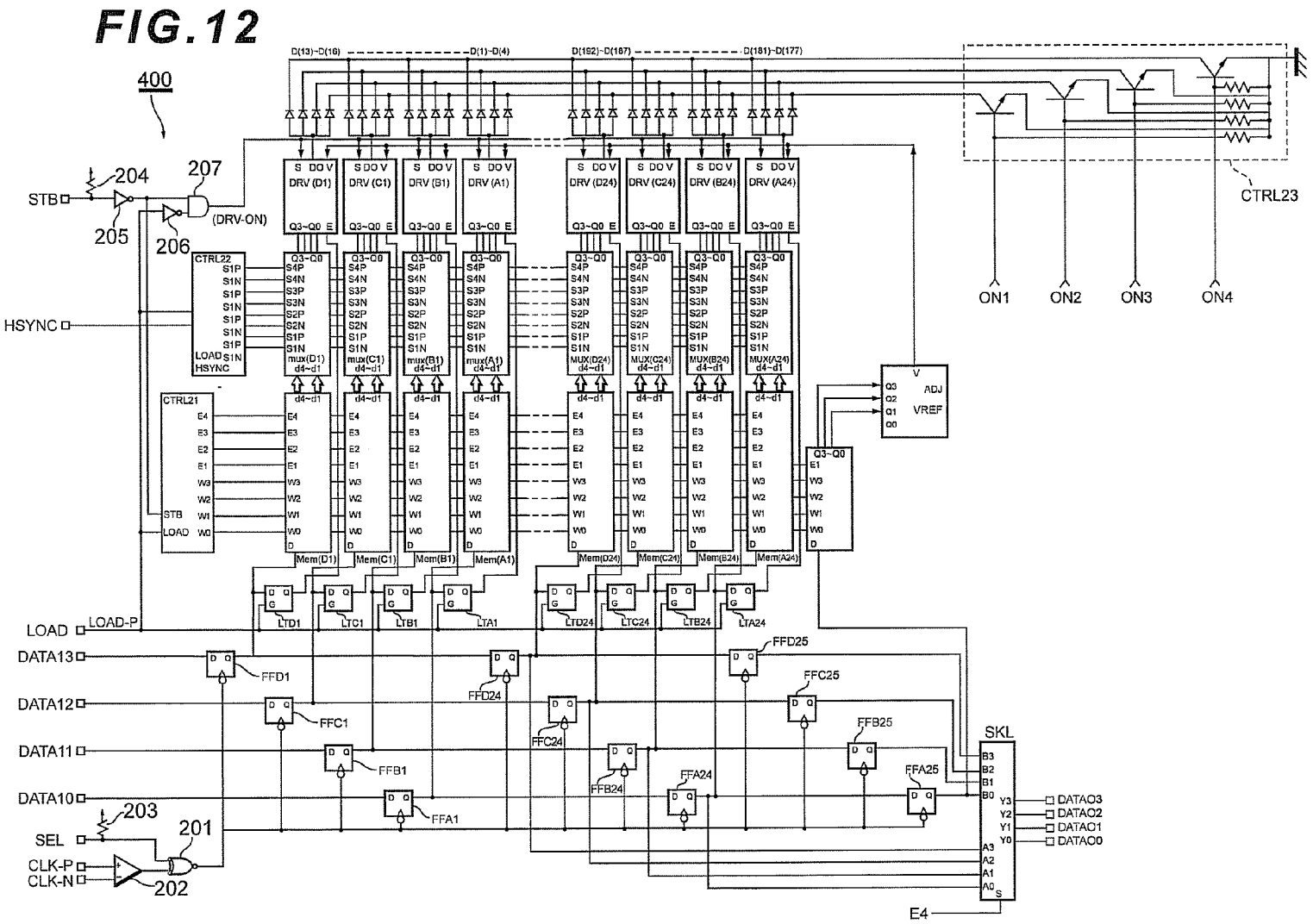
FIG. 12 is a block constructional diagram of a driver IC according to an embodiment 5.

FIG. 12 is a block constructional diagram of a driver IC according to the embodiment 5.

As shown in the diagram, a driver IC 400 in the embodiment 5 is realized merely by replacing the circuits in the driver IC 100 in the embodiment 1 as follows. That is, the control circuit CTRL1 is replaced by a control circuit CTRL21. The control circuit CTRL2 is replaced by a control circuit CTRL22. The control circuit CTRL3 is replaced by a control circuit CTRL23. The memory cell circuits MEM(A1) to MEM(A24) of the A group are replaced by memory cell circuits Mem(A1) to Mem(A24) of the A group. The memory cell circuits MEM(B1) to MEM(B24) of the B group are replaced by memory cell circuits Mem(B1) to Mem(B24) of the B group. The memory cell circuits MEM(C1) to MEM (C24) of the C group are replaced by memory cell circuits Mem(C1) to Mem(C24) of the C group. The memory cell circuits MEM(D1) to MEM(D24) of the D group are replaced by memory cell circuits Mem(D1) to Mem(D24) of the D group. The multiplexer circuits MUX(A1) to MUX(A24) of the A group are replaced by multiplexer circuits mux(A1) to mux(A24) of the A group. The multiplexer circuits MUX(B1) to MUX(B24) of the B group are replaced by multiplexer circuits mux(B1) to mux(B24) of the B group. The multiplexer circuits MUX(C1) to MUX(C24) of the C group are replaced by multiplexer circuits mux(C1) to mux(C24) of the C group. The multiplexer circuits MUX(D1) to MUX(D24) of the D group are replaced by multiplexer circuits mux(D1) to mux(D24) of the D group. Other portions are substantially similar to those of the driver IC 100 in the embodiment 1. Therefore, only the different portions will be described hereinbelow.

The control circuit CTRL21 is a circuit for receiving the latch signal LOAD-P from the LOAD terminal, receiving the strobe signal HD-STB-N through the inverter 205, and outputting the data writing signals (w0, w1, w2, w3) and data enable signals (e1, e2, e3, e4) to the memory cell circuits Mem(A1) to Mem(D24), respectively.

Figure 13:
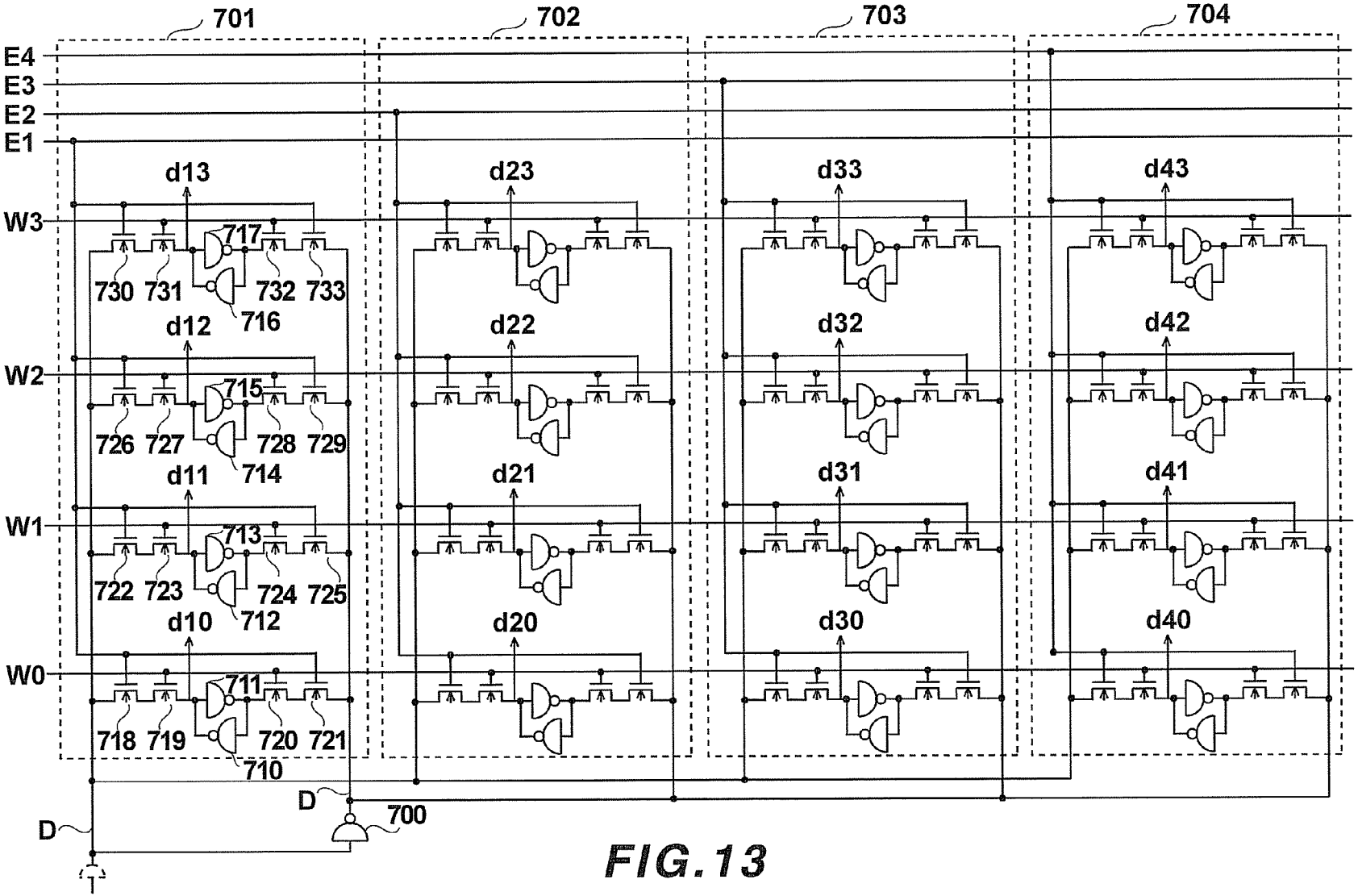
FIG. 13 is a circuit constructional diagram of a memory cell circuit in the embodiment 5.

FIG. 13 is a circuit constructional diagram of the memory cell circuit in the embodiment 5.

In the diagram, four dot memories corresponding to four adjacent dots are separately shown by areas 701 to 704 surrounded by broken lines. Reference numeral 701 denotes the dot memory for storing the correction data corresponding to the first LED device group such as dot 1, dot 5, dot 9, dot 13, . . . . Reference numeral 702 denotes the dot memory for storing the correction data corresponding to the second LED device group such as dot 2, dot 6, dot 10, dot 14, . . . . Reference numeral 703 denotes the dot memory for storing the correction data corresponding to the third LED device group such as dot 3, dot 7, dot 11, dot 15, . . . . Reference numeral 704 denotes the dot memory for storing the correction data corresponding to the fourth LED device group such as dot 4, dot 8, dot 12, dot 16, . . . .

Each of the dot memories 701 to 704 stores the dot correction data consisting of four bits per dot. Output terminals of the dot memories 701 to 704 are designated by reference numerals d13 to d10, d23 to d20, d33 to d30, and d43 to d40 in correspondence to weights (bit 3 to bit 0) of the bits which are stored, respectively.

The memory cell circuit Mem has a buffer (not shown). The memory cell circuit Mem also has: an inverter 700 connected to the buffer (not shown) in order to generate a data signal which is complementary to it; inverters 710 to 717 constructing a correction memory cell; and n-channel MOS transistors 718 to 733.

The following lines are arranged in the memory cell circuit Mem: the data line D; the data signal enable line E1 for receiving the data enable signal e1 to instruct "data writing enable" of dot 1, dot 5, dot 9, dot 13, . . . ; the data signal enable line E2 for receiving the data enable signal e2 to instruct "data writing enable" of dot 2, dot 6, dot 10, dot 14, . . . ; a data signal enable line E3 for receiving an data enable signal e3 to instruct "data writing enable" of dot 3, dot 7, dot 11, dot 15, . . . ; and a data signal enable line E4 for receiving an data enable signal e4 to instruct "data writing enable" of dot 4, dot 8, dot 12, dot 16, . . . .

Further, the word lines W0 to W3 and the following output terminals are arranged: d13 to d10 as output terminals of the correction data such as dot 1, dot 5, dot 9, dot 13, . . . ; d23 to d20 as output terminals of the correction data such as dot 2, dot 6, dot 10, dot 14, . . . ; d33 to d30 as output terminals of the correction data such as dot 3, dot 7, dot 11, dot 16, . . . ; and d43 to d40 as output terminals of the correction data such as dot 4, dot 8, dot 12, dot 16, . . . .

The data line D is connected to data output terminals Q of the flip-flops FFA1, FFB1, FFC1, FFD1, FFA2, . . . , FFA24, FFB24, FFC24, FFD24, . . . shown in FIG. 12, respectively. The word lines W0 to W3 are connected to the control circuit CTRL21 and receive the data writing signals (w0, w1, w2, w3). The data signal enable lines E1 to E4 are also connected to the control circuit CTRL21 and receive the data enable signals e1 to e4, respectively.

An output of the inverter 711 is connected to an input of the inverter 710, thereby forming a memory cell. Similarly, an output of the inverter 713 is connected to an input of the inverter 712, thereby forming a memory cell. An output of the inverter 715 is connected to an input of the inverter 714, thereby forming a memory cell. An output of the inverter 717 is connected to an input of the inverter 716, thereby forming a memory cell. The n-channel MOS transistors 718 and 719 are serially connected, one end of this serial connection is connected to an input of the memory cell formed by the inverters 710 and 711, the n-channel MOS transistors 720 and 721 are serially connected, and one end of this serial connection is connected to the input of this memory cell. The n-channel MOS transistors 722 and 723 are serially connected, one end of this serial connection is connected to an input of the memory cell formed by the inverters 712 and 713, the n-channel MOS transistors 724 and 725 are serially connected, and one end of this serial connection is connected to the input of this memory cell. The n-channel MOS transistors 726 and 727 are serially connected, one end of this serial connection is connected to an input of the memory cell formed by the inverters 714 and 715, the n-channel MOS transistors 728 and 729 are serially connected, and one end of this serial connection is connected to the input of this memory cell. The n-channel MOS transistors 730 and 731 are serially connected, one end of this serial connection is connected to an input of the memory cell formed by the inverters 716 and 717, the n-channel MOS transistors 732 and 733 are serially connected, and one end of this serial connection is connected to the input of this memory cell.

Gate electrodes of the n-channel MOS transistors 719 and 720 are connected to the word line W0. Gate electrodes of the n-channel MOS transistors 723 and 724 are connected to the word line W1. Gate electrodes of the n-channel MOS transistors 727 and 728 are connected to the word line W2. Gate electrodes of the n-channel MOS transistors 731 and 732 are connected to the word line W3.

The data signal enable line E1 is connected to gate electrodes of the n-channel MOS transistors 718, 721, 722, 725, 726, 729, 730, and 733 in the area 701. The data signal enable line E2 is connected to gate electrodes of the corresponding n-channel MOS transistors in the area 702. The data signal enable line E3 is connected to gate electrodes of the corresponding n-channel MOS transistors in the area 703. The data signal enable line E4 is connected to gate electrodes of the corresponding n-channel MOS transistors in the area 704.

An output of the inverter 710 is connected to the terminal d10. An output of the inverter 712 is connected to the terminal d11. An output of the inverter 714 is connected to the terminal d12. An output of the inverter 716 is connected to the terminal d13. Similarly, outputs of the inverters at the corresponding positions in the area 702 are connected to the terminals d23 to d20, respectively. Outputs of the inverters at the corresponding positions in the area 703 are connected to the terminals d33 to d30, respectively. Outputs of the inverters at the corresponding positions in the area 704 are connected to the terminals d43 to d40, respectively.

Figure 14:
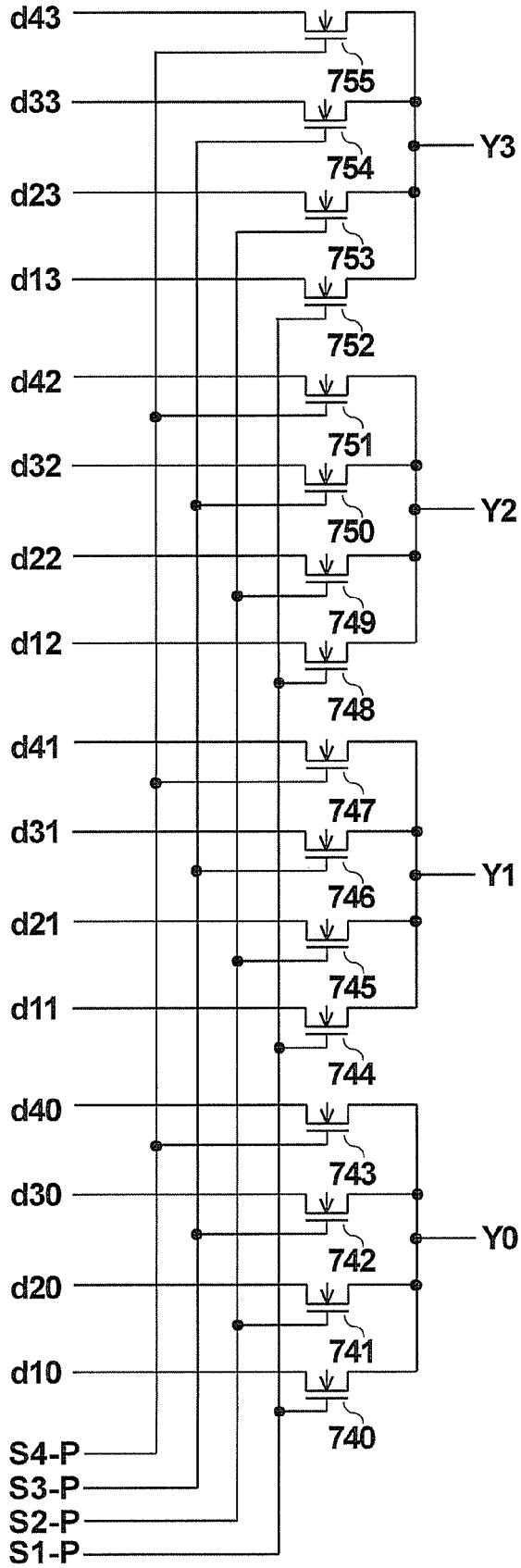
FIG. 14 is a circuit constructional diagram of a multiplexer circuit in the embodiment 5.

FIG. 14 is a circuit constructional diagram of a multiplexer circuit in the embodiment 5.

This diagram shows an internal construction of the multiplexer circuit mux in FIG. 12.

Reference numerals 740 to 755 denote n-channel MOS transistors. A d10 signal is inputted to a first electrode of the n-channel MOS transistor 740 and its second electrode is connected to the output terminal Y0. A d11 signal is inputted to a first electrode of the n-channel MOS transistor 744 and its second electrode is connected to the output terminal Y1. A d12 signal is inputted to a first electrode of the n-channel MOS transistor 748 and its second electrode is connected to the output terminal Y2. A d13 signal is inputted to a first electrode of the n-channel MOS transistor 752 and its second electrode is connected to the output terminal Y3.

A d20 signal is inputted to a first electrode of the n-channel MOS transistor 741 and its second electrode is connected to the output terminal Y0. A d21 signal is inputted to a first electrode of the n-channel MOS transistor 745 and its second electrode is connected to the output terminal Y1. A d22 signal is inputted to a first electrode of the n-channel MOS transistor 749 and its second electrode is connected to the output terminal Y2. A d23 signal is inputted to a first electrode of the n-channel MOS transistor 753 and its second electrode is connected to the output terminal Y3. A d30 signal is inputted to a first electrode of the n-channel MOS transistor 742 and its second electrode is connected to the output terminal Y0. A d31 signal is inputted to a first electrode of the n-channel MOS transistor 746 and its second electrode is connected to the output terminal Y1.

A d32 signal is inputted to a first electrode of the n-channel MOS transistor 750 and its second electrode is connected to the output terminal Y2. A d33 signal is inputted to a first electrode of the n-channel MOS transistor 754 and its second electrode is connected to the output terminal Y3. A d40 signal is inputted to a first electrode of the n-channel MOS transistor 743 and its second electrode is connected to the output terminal Y0. A d41 signal is inputted to a first electrode of the n-channel MOS transistor 747 and its second electrode is connected to the output terminal Y1. A d42 signal is inputted to a first electrode of the n-channel MOS transistor 751 and its second electrode is connected to the output terminal Y2. A d43 signal is inputted to a first electrode of the n-channel MOS transistor 755 and its second electrode is connected to the output terminal Y3.

The data signal selecting line S1-P is connected to gate electrodes of the n-channel MOS transistors 740, 744, 748, and 752. The data signal selecting line S2-P is connected to gate electrodes of the n-channel MOS transistors 741, 745, 749, and 753. A data signal selecting line S3-P is connected to gate electrodes of the n-channel MOS transistors 742, 746, 750, and 754. A data signal selecting line S4-P is connected to gate electrodes of the n-channel MOS transistors 743, 747, 751, and 755.

When the data signal selecting line S1-P is at the H level, the data signal selecting lines S2-P to S4-P are set to the L (low) level. Therefore, the n-channel MOS transistors 740, 744, 748, and 752 are ON and the n-channel MOS transistors 741 to 743, 745 to 747, 749 to 751, and 753 to 755 are turned off, respectively. At this time, the d10 signal inputted to the multiplexer circuit mux is outputted from the Y0 terminal through the n-channel MOS transistor 740 in the ON-state. At the output terminals Y1 to Y3, the same logic values as those at the terminals d11, d12, and d13 are also outputted.

As another case, when the data signal selecting line S2-P is at the H level, the data signal selecting lines S1-P, S3-P, and S4-P are set to the L level. Therefore, the n-channel MOS transistors 741, 745, 749, and 753 are ON and the n-channel MOS transistors 740, 742, 743, 744, 746, 747, 748, 750, 751, 752, 754, 755 are turned off, respectively. At this time, the d20 signal inputted to the multiplexer circuit mux is outputted from the Y0 terminal through the n-channel MOS transistor 741 in the ON-state. Also at the output terminals Y1 to Y3, the same logic values as those at the terminals d21, d22, and d23 are outputted.

Similarly, when the data signal selecting line S3-P is at the H level, the data signal selecting lines S1-P, S2-P, and S4-P are set to the L level. Therefore, the same logic values as those at the terminals d30, d31, d32, and d33 are outputted to the output terminals Y0 to Y3. When the data signal selecting line S4-P is at the H level, the data signal selecting lines S1-P, S2-P, and S3-P are set to the L level. Therefore, the same logic values as those at the terminals d40, d41, d42, and d43 are outputted to the output terminals Y0 to Y3, respectively.

As mentioned above, the signal selected at d10 to d40 in accordance with the logic values of the signals of the data signal selecting lines S1-P to S4-P is outputted from the output terminal Y0. Similarly, among d11 to d41, the signal selected in accordance with the logic values of the signals of the data signal selecting lines S1-P to S4-P is outputted from the output terminal Y1. Similarly, among d12 to d42, the signal selected in accordance with the logic values of the signals of the data signal selecting lines S1-P to S4-P is outputted from the output terminal Y2. Likewise, among d13 to d43, the signal selected in accordance with the logic values of the signals of the data signal selecting lines S1-P to S4-P is outputted from the output terminal Y3.

Figure 15:
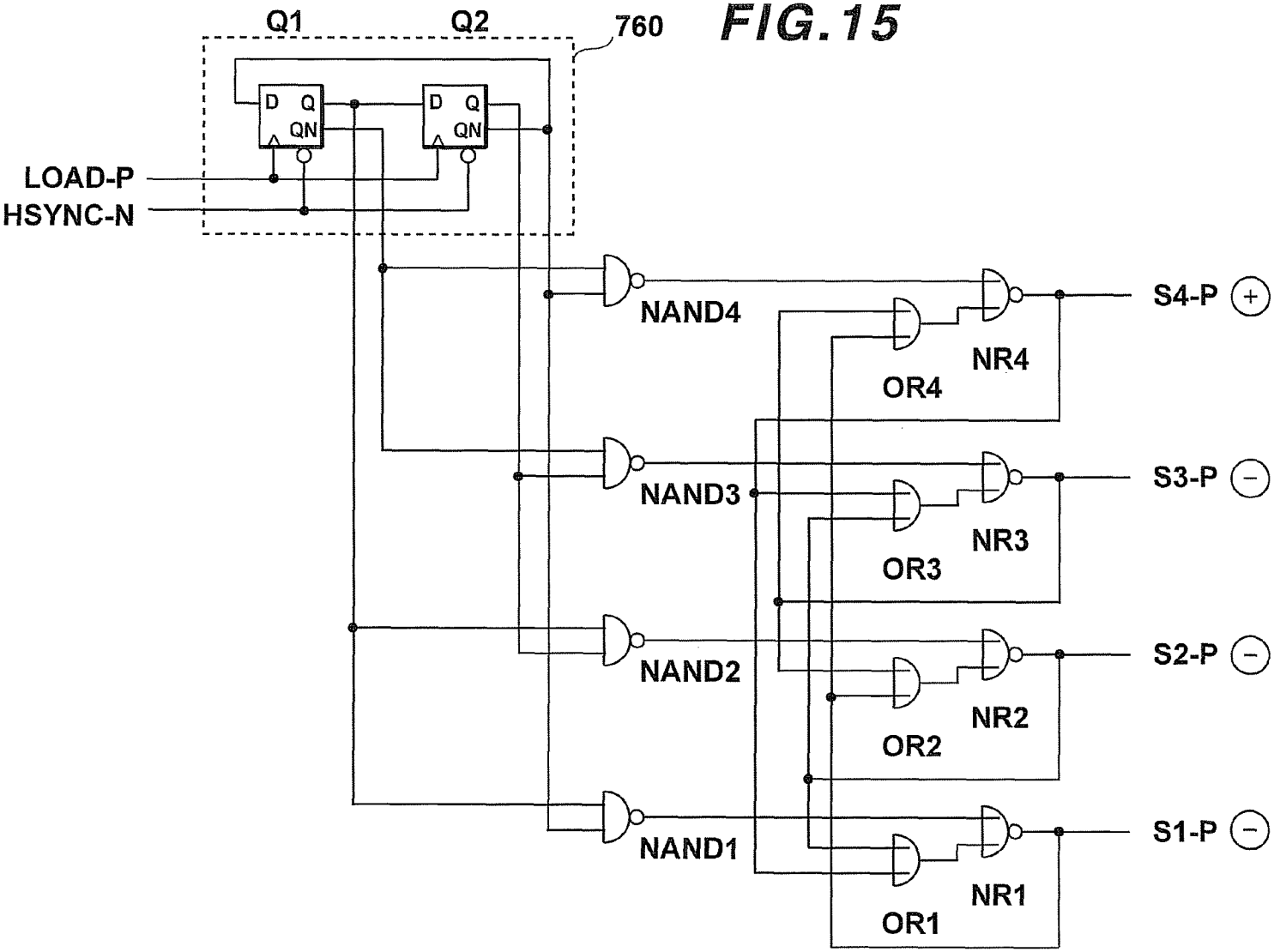
FIG. 15 is a circuit constructional diagram of switching signal generating means in the embodiment 5.

FIG. 15 is a circuit constructional diagram of switching signal generating means in the embodiment 5.

This diagram shows an internal construction of the control circuit CTRL22 in FIG. 12.

In the diagram, Q1 and Q2 denote flip-flops. A hatched portion 760 indicates a Johnson counter circuit using the flip-flops Q1 and Q2. NAND1 to NAND4 indicate NAND gates. OR1 to OR4 indicate OR gates. NR1 to NR4 indicate NOR gates.

In the Johnson counter circuit 760, the Q output of the flip-flop Q1 is connected to a D input of the flip-flop Q2. A QN output of Q2 is connected to the D input of Q1. The LOAD-P signal as a latch signal is inputted to clock input terminals of the flip-flops Q1 and Q2. The HSYNC-N signal as a sync signal of the head is inputted to reset terminals of Q1 and Q2.

One input terminal of the NAND gate NAND4 is connected to the QN output of Q1 and the other input terminal is connected to the QN output of Q2. One input terminal of the NAND gate NAND3 is connected to the QN output of Q1 and the other input terminal is connected to the Q output of Q2. One input terminal of the NAND gate NAND2 is connected to the Q output of Q1 and the other input terminal is connected to the Q output of Q2.

One input terminal of the NAND gate NAND1 is connected to the Q output of Q1 and the other input terminal is connected to the QN output of Q2. One input terminal of the NOR gate NR4 is connected to an output of the NAND gate NAND4 and the other input is connected to an output of the OR gate OR4. An output of the NOR gate NR4 is connected to the data signal selecting line S4-P.

One input terminal of the NOR gate NR3 is connected to an output of the NAND gate NAND3 and the other input is connected to an output of the OR gate OR3. An output of the NOR gate NR3 is connected to the data signal selecting line S3-P. One input terminal of the NOR gate NR2 is connected to an output of the NAND gate NAND2 and the other input is connected to an output of the OR gate OR2. An output of the NOR gate NR2 is connected to the data signal selecting line S2-P. One input terminal of the NOR gate NR1 is connected to an output of the NAND gate NAND1 and the other input is connected to an output of the OR gate OR1. An output of the NOR gate NR1 is connected to the data signal selecting line S1-P.

One input terminal of the OR gate OR4 is connected to an output of the NOR gate NR3 and the other input is connected to the output of the NOR gate NR1. One input terminal of the OR gate OR3 is connected to the output of the NOR gate NR2 and the other input is connected to the output of the NOR gate NR4. One input terminal of the OR gate OR2 is connected to the output of the NOR gate NR1 and the other input is connected to the output of the NOR gate NR3. One input terminal of the OR gate OR1 is connected to the output of the NOR gate NR4 and the other input is connected to the output of the NOR gate NR2. Subsequently, the reason why such a situation that the control circuit simultaneously turns on the data signal selecting lines S1-P, S2-P, S3-P, and S4-P in their state transition steps does not occur will now be described.

When the control circuit CTRL22 (FIG. 12) receives the negative polarity pulse of the HSYNC-N signal, the two flip-flops Q1 and Q2 are initialized and their outputs are set to the L level. Thus, the data signal selecting line S4-P is set to the H level and the data signal selecting lines S1-P to S3-P are set to the L level.

Subsequently, when the transferring processes of the first, fifth, ninth, and . . . dot data (not shown) are completed and the latch signal LOAD-P is inputted, the logic value of Q1 is inverted, the Q output is set to the H level, the QN output is set to the L level, the Q output of Q2 is set to the L level, and the QN output is set to the H level.

Thus, the output of the NAND gate NAND1 is shifted from the H level to the L level and the output of the NAND gate NAND4 rises from the L level to the H level. The output of the NOR gate NR4 is connected to the inputs of the OR gates OR3 and OR1. The output of the NOR gate NR3 is connected to the inputs of the OR gates OR2 and OR4. The output of the NOR gate NR2 is connected to the inputs of the OR gates OR1 and OR3. The output of the NOR gate NR1 is connected to the inputs of the OR gates OR2 and OR4. Therefore, an output waveform of the NAND gate NAND1 trails and an output waveform of the NAND gate NAND4 rises. An influence by the above signal transition appears in the data signal selecting line S4-P first of all and the data signal selecting line S4-P is set to the L level. Subsequently, the outputs of the OR gates OR1 and OR3 trail and, further, the data signal selecting line S1-P is set to the H level after the elapse of a delay time. Thereafter, the outputs of the OR gates OR2 and OR4 rise.

Subsequently, when the data transfer of the second dot, sixth dot, tenth dot, fourteenth dot, . . . (not shown) is completed and the second latch signal (LOAD-P) is inputted, the logic value of Q2 is inverted, and the Q output is shifted from the L level to the H level. The Q output of Q1 in this instance is held at the H level and the QN output is held at the L level. Consequently, the output of the NAND gate NAND1 rises and the output of the NAND gate NAND2 trails. In this instance, an influence by the above signal transition appears in the data signal selecting line S1-P first of all and the data signal selecting line S1-P is set to the L level. Subsequently, the outputs of the OR gates OR2 and OR4 trail and, further, the data signal selecting line S2-P is set to the H level after the elapse of a delay time. Thereafter, the outputs of the OR gates OR1 and OR3 rise.

Subsequently, when the data transfer of the third dot, seventh dot, eleventh dot, fifteenth dot, . . . (not shown) is completed and the third latch signal (LOAD-P) is inputted, the logic value of Q1 is inverted and the Q output is shifted from the H level to the L level. The Q output of Q2 in this instance is held at the H level and the QN output is held at the L level.

Consequently, the output of the NAND gate NAND2 rises and the output of the NAND gate NAND3 trails. In this instance, an influence by the above signal transition appears in the data signal selecting line S2-P first of all and the data signal selecting line S2-P is set to the L level. Subsequently, the outputs of the OR gates OR1 and OR3 trail and, further, the data signal selecting line S3-P is set to the H level after the elapse of a delay time. Thereafter, the outputs of the OR gates OR2 and OR4 rise.

Subsequently, when the data transfer of the fourth dot, eighth dot, twelfth dot, sixteenth dot, . . . (not shown) is completed and the fourth latch signal (LOAD-P) is inputted, the logic value of Q2 is inverted and the Q output is shifted from the H level to the L level. The Q output of Q1 in this instance is held at the L level and the QN output is held at the H level. Consequently, the output of the NAND gate NAND3 rises and the output of the NAND gate NAND4 trails. In this instance, an influence by the above signal transition appears in the data signal selecting line S3-P first of all and the data signal selecting line S3-P is set to the L level. Subsequently, the outputs of the OR gates OR2 and OR4 trail and, further, the data signal selecting line S4-P is set to the H level after the elapse of a delay time. Thereafter, the outputs of the OR gates OR1 and OR3 rise. In this manner, the similar operation is repeated hereinafter.

The image forming apparatus including the driver IC 400 (FIG. 12) described above executes the printing in accordance with the following four processing steps.

Step S5-1

After the sync signal HSYNC-N showing the start of the printing of one line was inputted, the data of dot 1, dot 5, dot 9, dot 13, . . . and dot 4989 is transmitted. The LOAD signal is inputted, thereby allowing the input data to be latched and allowing dot 1, dot 5, dot 9, dot 13, . . . , and dot 4989 among the LED devices according to a strobe signal STB-N to perform the light emission.

Step S5-2

Subsequently, the data of dot 2, dot 6, dot 10, dot 14, and dot 4990 is transmitted. The LOAD signal is inputted, thereby allowing the input data to be latched and allowing dot 2, dot 6, dot 10, dot 14, . . . , and dot 4990 among the LED devices according to the strobe signal STB-N to perform the light emission.

Step S5-3

Subsequently, the data of dot 3, dot 7, dot 11, dot 15, and dot 4991 is transmitted. The LOAD signal is inputted, thereby allowing the input data to be latched and allowing dot 3, dot 7, dot 11, dot 15, . . . , and dot 4991 among the LED devices according to the strobe signal STB-N to perform the light emission.

Step S5-4

Further, the data of dot 4, dot 8, dot 12, dot 16, . . . , and dot 4992 is transmitted. The LOAD signal is inputted, thereby allowing the input data to be latched and allowing dot 4, dot 8, dot 12, dot 16, . . . , and dot 4992 among the LED devices according to the strobe signal STB-N to perform the light emission.

As described above, even in the case where the 192 LED devices D(1) to D(192) are arranged and connected to one LED driving circuit in the layout order of those LED devices so that the four LED devices form one set and they are controlled by the driver IC 400 according to the embodiment, the timing when both of the data signal selecting lines are turned off can be inserted in the middle of the ON-timing for switching the correction data of every dot. Therefore, such a technique which has been performed in the related art that the buffer is interposed between the memory cell output and the multiplexer data input in order to prevent the inversion of the data in the memory cell becomes unnecessary. Thus, such an effect that it is possible to contribute to the cost reduction of the LED head is obtained.

Embodiment 6

The above embodiment 5 has been described with respect to the case where the 192 LED devices D(1) to D(192) are arranged and connected to one LED driving circuit in the layout order of those LED devices so that the four LED devices form one set and they are controlled. In the embodiment 6, it is assumed that the switching devices in the multiplexer circuit mux (FIG. 12) in the embodiment 5 are replaced by the n-channel MOS transistors and transmission gates are used. For this purpose, the data selecting signal generating circuit has eight output signals. Therefore, the embodiment 6 differs from the embodiment 5 only with respect to the multiplexer circuit and the selecting signal generating means. Other portions are substantially similar to those of the embodiment 5. Therefore, only the multiplexer circuit and the selecting signal generating means will be described hereinbelow.

Figure 16:
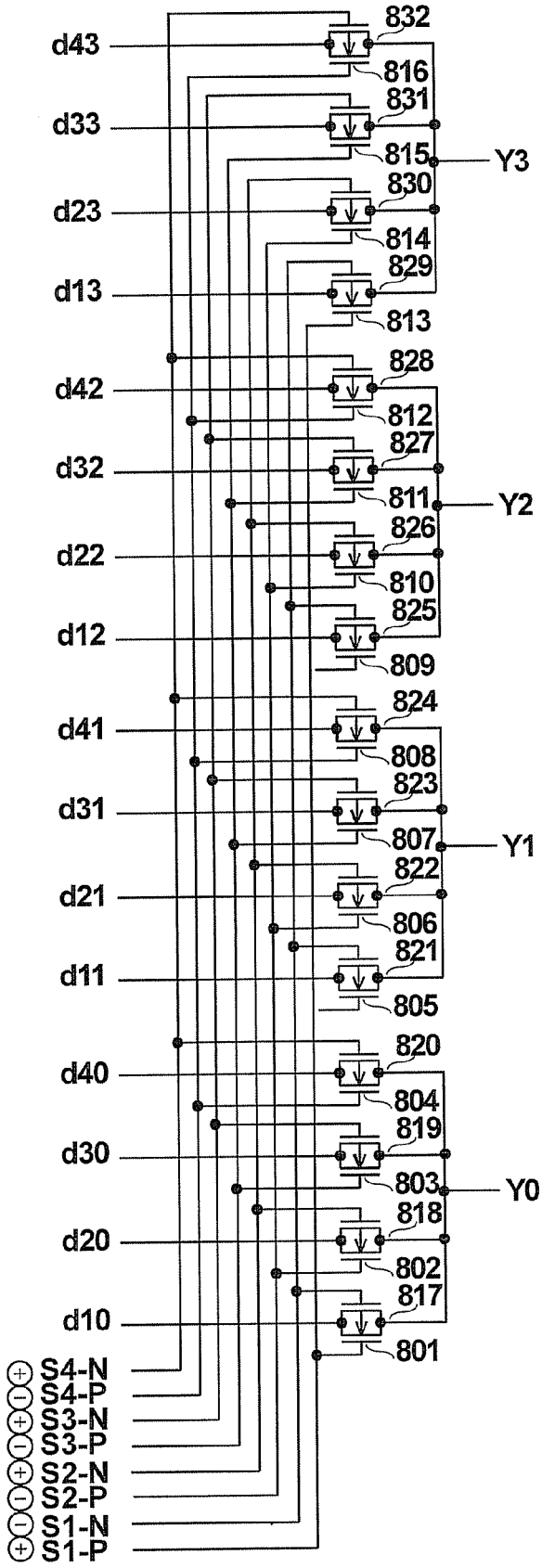
FIG. 16 is a circuit constructional diagram of a multiplexer circuit according to an embodiment 6.

FIG. 16 is a circuit constructional diagram of the multiplexer circuit in the embodiment 6.

In the diagram, reference numerals 801 to 816 denote n-channel MOS transistors and 817 to 832 denote p-channel MOS transistors. The d10 signal is inputted to a first electrode of the n-channel MOS transistor 801 and its second electrode is connected to the output terminal Y0. The d11 signal is inputted to a first electrode of the n-channel MOS transistor 805 and its second electrode is connected to the output terminal Y1. The d12 signal is inputted to a first electrode of the n-channel MOS transistor 809 and its second electrode is connected to the output terminal Y2. The d13 signal is inputted to a first electrode of the n-channel MOS transistor 813 and its second electrode is connected to the output terminal Y3.

The d20 signal is inputted to a first electrode of the n-channel MOS transistor 802 and its second electrode is connected to the output terminal Y0. The d21 signal is inputted to a first electrode of the n-channel MOS transistor 806 and its second electrode is connected to the output terminal Y1. The d22 signal is inputted to a first electrode of the n-channel MOS transistor 810 and its second electrode is connected to the output terminal Y2. The d23 signal is inputted to a first electrode of the n-channel MOS transistor 814 and its second electrode is connected to the output terminal Y3.

The d30 signal is inputted to a first electrode of the n-channel MOS transistor 803 and its second electrode is connected to the output terminal Y0. The d31 signal is inputted to a first electrode of the n-channel MOS transistor 807 and its second electrode is connected to the output terminal Y1. The d32 signal is inputted to a first electrode of the n-channel MOS transistor 811 and its second electrode is connected to the output terminal Y2. The d33 signal is inputted to a first electrode of the n-channel MOS transistor 815 and its second electrode is connected to the output terminal Y3.

The d40 signal is inputted to a first electrode of the n-channel MOS transistor 804 and its second electrode is connected to the output terminal Y0. The d41 signal is inputted to a first electrode of the n-channel MOS transistor 808 and its second electrode is connected to the output terminal Y1. The d42 signal is inputted to a first electrode of the n-channel MOS transistor 812 and its second electrode is connected to the output terminal Y2. The d43 signal is inputted to a first electrode of the n-channel MOS transistor 816 and its second electrode is connected to the output terminal Y3.

The d10 signal is inputted to a first electrode of the p-channel MOS transistor 817 and its second electrode is connected to the output terminal Y0. The d11 signal is inputted to a first electrode of the p-channel MOS transistor 821 and its second electrode is connected to the output terminal Y1. The d12 signal is inputted to a first electrode of the p-channel MOS transistor 825 and its second electrode is connected to the output terminal Y2. The d13 signal is inputted to a first electrode of the p-channel MOS transistor 829 and its second electrode is connected to the output terminal Y3.

The d20 signal is inputted to a first electrode of the p-channel MOS transistor 818 and its second electrode is connected to the output terminal Y0. The d21 signal is inputted to a first electrode of the p-channel MOS transistor 822 and its second electrode is connected to the output terminal Y1. The d22 signal is inputted to a first electrode of the p-channel MOS transistor 826 and its second electrode is connected to the output terminal Y2. The d23 signal is inputted to a first electrode of the p-channel MOS transistor 830 and its second electrode is connected to the output terminal Y3.

The d30 signal is inputted to a first electrode of the p-channel MOS transistor 819 and its second electrode is connected to the output terminal Y0. The d31 signal is inputted to a first electrode of the p-channel MOS transistor 823 and its second electrode is connected to the output terminal Y1. The d32 signal is inputted to a first electrode of the p-channel MOS transistor 827 and its second electrode is connected to the output terminal Y2. The d33 signal is inputted to a first electrode of the p-channel MOS transistor 831 and its second electrode is connected to the output terminal Y3.

The d40 signal is inputted to a first electrode of the p-channel MOS transistor 820 and its second electrode is connected to the output terminal Y0. The d41 signal is inputted to a first electrode of the p-channel MOS transistor 824 and its second electrode is connected to the output terminal Y1. The d42 signal is inputted to a first electrode of the p-channel MOS transistor 828 and its second electrode is connected to the output terminal Y2. The d43 signal is inputted to a first electrode of the p-channel MOS transistor 832 and its second electrode is connected to the output terminal Y3.

The data signal selecting line S1-P is connected to gate electrodes of the n-channel MOS transistors 801, 805, 809, and 813. The data signal selecting line S2-P is connected to gate electrodes of the n-channel MOS transistors 802, 806, 810, and 814. The data signal selecting line S3-P is connected to gate electrodes of the n-channel MOS transistors 803, 807, 811, and 815. The data signal selecting line S4-P is connected to gate electrodes of the n-channel MOS transistors 804, 808, 812, and 816.

The data signal selecting line S1-N is connected to gate electrodes of the p-channel MOS transistors 817, 821, 825, and 829. The data signal selecting line S2-N is connected to gate electrodes of the p-channel MOS transistors 818, 822, 826, and 830. A data signal selecting line S3-N is connected to gate electrodes of the p-channel MOS transistors 819, 823, 827, and 831. A data signal selecting line S4-N is connected to gate electrodes of the p-channel MOS transistors 820, 824, 828, and 832.

In the multiplexer circuit, when the data signal selecting line S1-P is at the H level, the data signal selecting line S1-N is set to the L level, the data signal selecting lines S2-P to S4-P are set to the L level, and the data signal selecting lines S2-N to S4-N are set to the H level, respectively. At this time, the n-channel MOS transistors 801, 805, 809, and 813 are ON and the p-channel MOS transistors 817, 821, 825, and 829 are also ON, respectively. The MOS transistors 802 to 804, 818 to 820, 806 to 808, 822 to 824, 810 to 812, 826 to 828, 814 to 816, and 830 to 832 are turned off, respectively.

In this instance, the d10 signal inputted to the multiplexer circuit is outputted from the Y0 terminal through the MOS transistors 801 and 817 in the ON-state. Also at the output terminals Y1 to Y3, similarly, the same logic values as those at the terminals d11, d12, and d13 are outputted. As another case, when the data signal selecting line S2-P is at the H level, the data signal selecting lines S1-P, S3-P, and S4-P are set to the L level, the data signal selecting line S2-N is set to the L level, and the data signal selecting lines S1-N, S3-N, and S4-N are set to the H level, respectively. At this time, the n-channel MOS transistors 802, 806, 810, and 814 are ON and the p-channel MOS transistors 818, 822, 826, and 830 are also ON, respectively.

The MOS transistors 801, 803, 804, 805, 807, 808, 809, 811, 812, 813, 815, 816, 817, 819, 820, 821, 823, 824, 825, 827, 828, 829, 831, and 832 are turned off, respectively. At this time, the d20 signal inputted to the multiplexer circuit is outputted from the Y0 terminal through the MOS transistors 802 and 818 in the ON-state. Also at the output terminals Y1 to Y3, the same logic values as those at the terminals d21, d22, and d23 are outputted.

Similarly, when the data signal selecting line S3-P is at the H level, the data signal selecting lines S1-P, S2-P, and S4-P are set to the L level, the data signal selecting line S3-N is set to the L level, and the data signal selecting lines S1-N, S2-N, and S4-N are set to the H level, respectively. At this time, the same logic values as those at the terminals d30, d31, d32, and d33 are outputted to the output terminals Y0 to Y3, respectively. When the data signal selecting line S4-P is at the H level, the data signal selecting lines S1-P, S2-P, and S3-P are set to the L level, the data signal selecting line S4-N is set to the L level, and the data signal selecting lines S1-N, S2-N, and S3-N are set to the L level, respectively. At this time, the same logic values as those at the terminals d40, d41, d42, and d43 are outputted to the output terminals Y0 to Y3, respectively.

As mentioned above, among d10 to d40, the signal selected in accordance with the logic values of the signals of the data signal selecting lines S1-P to S4-P and S1-N to S4-N is outputted from the output terminal Y0. The signal selected among d11 to d41 is outputted from the output terminal Y1. The signal selected among d12 to d42 is outputted from the output terminal Y2. The signal selected among d13 to d43 is outputted from the output terminal Y3. In this manner, each signal is alternatively selected and outputted from the corresponding terminal.

Figure 17:
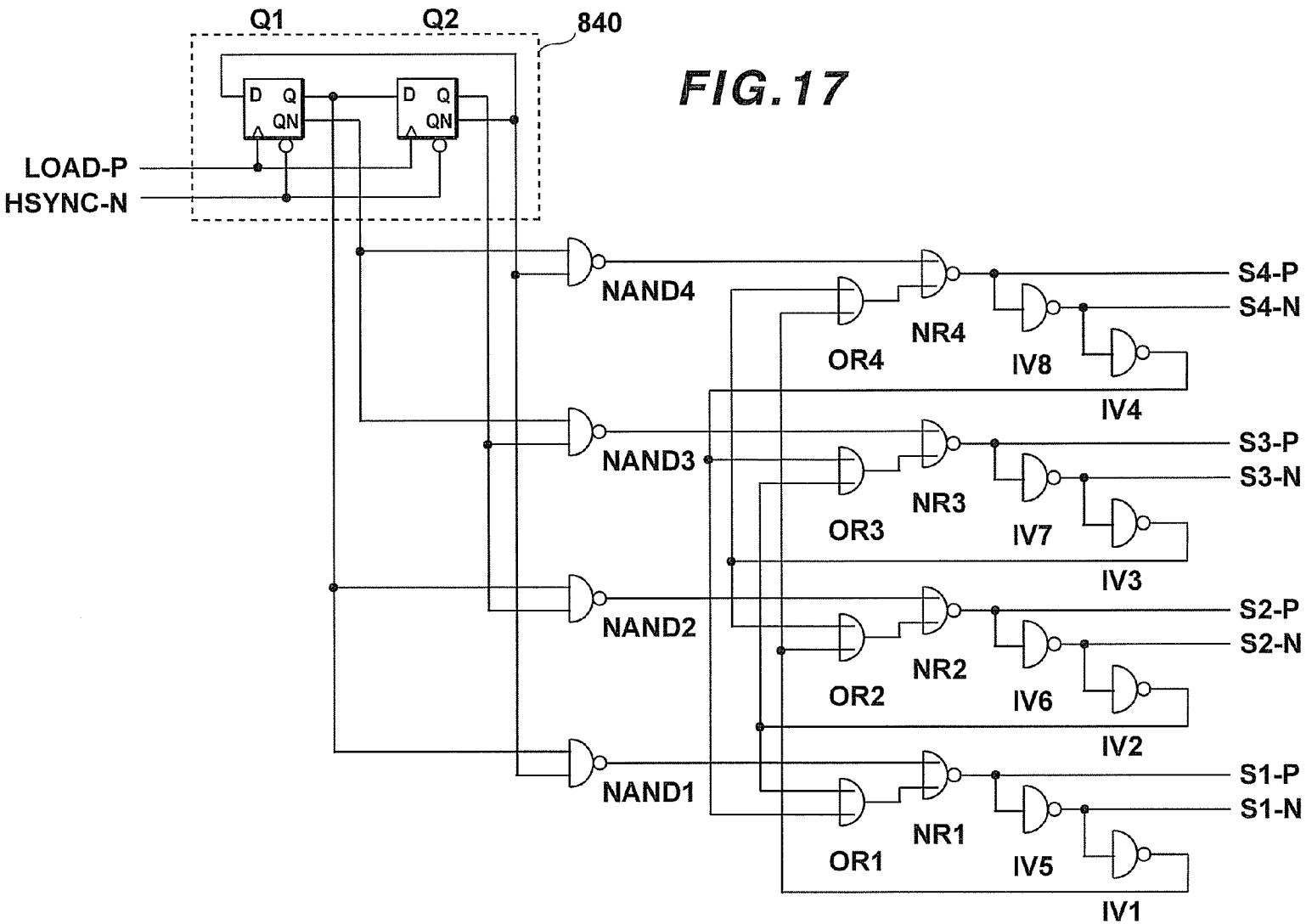
FIG. 17 is a circuit constructional diagram of switching signal generating means in the embodiment 6.

FIG. 17 is a circuit constructional diagram of the selecting signal generating means in the embodiment 6.

In the diagram, Q1 and Q2 denote the flip-flops. A hatched portion 840 indicates a Johnson counter circuit using the flip-flops Q1 and Q2. NAND1 to NAND4 indicate the NAND gates. OR1 to OR4 indicate the OR gates. NR1 to NR4 indicate the NOR gates. IV1 to IV8 indicate inverters.

In the Johnson counter circuit 840, the Q output of the flip-flop Q1 is connected to the D input of the flip-flop Q2. The QN output of Q2 is connected to the D input of Q1. The LOAD-P signal as a latch signal is inputted to the clock input terminals of the flip-flops Q1 and Q2. The HSYNC-N signal as a sync signal of the head is inputted to the reset terminals of Q1 and Q2.

One input terminal of the NAND gate NAND4 is connected to the QN output of Q1 and the other input terminal is connected to the QN output of Q2. One input terminal of the NAND gate NAND3 is connected to the QN output of Q1 and the other input terminal is connected to the Q output of Q2.

One input terminal of the NAND gate NAND2 is connected to the Q output of Q1 and the other input terminal is connected to the Q output of Q2. One input terminal of the NAND gate NAND1 is connected to the Q output of Q1 and the other input terminal is connected to the QN output of Q2.

One input terminal of the NOR gate NR4 is connected to the output of the NAND gate NAND4 and the other input is connected to the output of the OR gate OR4. The output of the NOR gate NR4 is connected to the data signal selecting line S4-P. One input terminal of the NOR gate NR3 is connected to the output of the NAND gate NAND3 and the other input is connected to the output of the OR gate OR3. The output of the NOR gate NR3 is connected to the data signal selecting line S3-P. One input terminal of the NOR gate NR2 is connected to the output of the NAND gate NAND2 and the other input is connected to the output of the OR gate OR2. The output of the NOR gate NR2 is connected to the data signal selecting line S2-P. One input terminal of the NOR gate NR1 is connected to the output of the NAND gate NAND1 and the other input is connected to the output of the OR gate OR1. The output of the NOR gate NR1 is connected to the data signal selecting line S1-P.

One input terminal of the OR gate OR4 is connected to the output of the inverter IV3 and the other input is connected to the output of the inverter IV1. One input terminal of the OR gate OR3 is connected to the output of the inverter IV2 and the other input is connected to the output of the inverter IV4. One input terminal of the OR gate OR2 is connected to the output of the inverter IV1 and the other input is connected to the output of the inverter IV3. One input terminal of the OR gate OR1 is connected to the output of the inverter IV4 and the other input is connected to the output of the inverter IV2.

An input of the inverter IV5 is connected to the output of the NOR gate NR1. An output of the inverter IV5 is connected to the data signal selecting line S1-N. An input of the inverter IV6 is connected to the output of the NOR gate NR2. An output of the inverter IV6 is connected to the data signal selecting line S2-N. An input of the inverter IV7 is connected to the output of the NOR gate NR3. An output of the inverter IV7 is connected to the data signal selecting line S3-N. An input of the inverter IV8 is connected to the output of the NOR gate NR4. An output of the inverter IV8 is connected to the data signal selecting line S4-N. The input of the inverter IV1 is connected to the output of the inverter IV5. The input of the inverter IV2 is connected to the output of the inverter IV6. The input of the inverter IV3 is connected to the output of the inverter IV7. The input of the inverter IV4 is connected to the output of the inverter IV8.

Subsequently, the reason why such a situation that the control circuit simultaneously turns on the data signal selecting lines S1-P, S2-P, S3-P, S4-P, S1-N, S2-N, S3-N, and S4-N in their state transition steps does not occur will now be described.

When the control circuit CTRL22 (FIG. 12) receives the negative polarity pulse of the HSYNC-N signal, the two flip-flops Q1 and Q2 are initialized and their outputs are set to the L level. Thus, the data signal selecting line S4-P is set to the H level and the data signal selecting lines S1-P to S3-P are set to the L level. The data signal selecting line S4-N is set to the L level and the data signal selecting lines S1-N to S3-N are set to the H level.

Subsequently, when the transferring processes of the data of the 1st dot, 5th dot, 9th dot, . . . (not shown) are completed and the latch signal LOAD-P is inputted, the logic value of Q1 is inverted, the Q output of Q1 is set to the H level, the QN output is set to the L level, the Q output of Q2 is set to the L level, and the QN output is set to the H level. Thus, the output of the NAND gate NAND1 is shifted from the H level to the L level and the output of the NAND gate NAND4 rises from the L level to the H level. The output of the NOR gate NR4 is connected to the inputs of the OR gates OR3 and OR1 through the inverters IV8 and IV1. The output of the NOR gate NR3 is connected to the inputs of the OR gates OR2 and OR4 through the inverters IV7 and IV3. The output of the NOR gate NR2 is connected to the inputs of the OR gates OR1 and OR3 through the inverters IV6 and IV2. The output of the NOR gate NR1 is connected to the inputs of the OR gates OR2 and OR4 through the inverters IV5 and IV1.

Now, the output of the NAND gate NAND1 trails and the output of the NAND gate NAND4 rises. At this time, an influence by the above signal transition appears in the data signal selecting line S4-P first of all and the data signal selecting line S4-P is set to the L level. Subsequently, the inverter IV4 trails, the outputs of the OR gates OR1 and OR3 trail, and the data signal selecting line S1-P is set to the H level and, further, the data signal selecting line S1-N is set to the L level after the elapse of a delay time. Thereafter, the outputs of the OR gates OR2 and OR4 rise through the inverter IV1.

Subsequently, when the data transfer of the 2nd dot, 6th dot, 10th dot, 14th dot, . . . (not shown) is completed and the second latch signal (LOAD-P) is inputted, the logic value of Q2 is inverted, and the Q output is shifted from the L level to the H level. At this time, the Q output of Q1 is held at the H level and the QN output is held at the L level. Consequently, the output of the NAND gate NAND1 rises and the output of the NAND gate NAND2 trails. In this instance, an influence by the above signal transition appears in the data signal selecting line S1-P first of all and the data signal selecting line S1-P is set to the L level.

Subsequently, the inverter IV1 trails, the outputs of the OR gates OR2 and OR4 trail, and further, the data signal selecting line S2-P is set to the H level after the elapse of a delay time. Thereafter, the inverter IV2 rises and the outputs of the OR gates OR1 and OR3 rise. Subsequently, the data transfer of the 3rd dot, 7th dot, 11th dot, 15th dot, . . . (not shown) is completed and the third latch signal (LOAD-P) is inputted. Thus, the logic value of Q1 is inverted and the Q output is shifted from the H level to the L level. At this time, the Q output of Q2 is held at the H level and the QN output is held at the L level.

Consequently, the output of the NAND gate NAND2 rises and the output of the NAND gate NAND3 trails. In this instance, an influence by the above signal transition appears in the data signal selecting line S2-P first of all and the data signal selecting line S2-P is set to the L level. Subsequently, the inverter IV2 rises, the outputs of the OR gates OR1 and OR3 trail, and further, the data signal selecting line S3-P is set to the H level after the elapse of a delay time. Thereafter, the inverter IV3 rises and the outputs of the OR gates OR2 and OR4 rise.

Subsequently, when the data transfer of the 4th dot, 8th dot, 12th dot, 16th dot, . . . (not shown) is completed and the fourth latch signal (LOAD-P) is inputted, the logic value of Q2 is inverted and the Q output is shifted from the H level to the L level. The Q output of Q2 in this instance is held at the L level and the QN output is held at the H level. Consequently, the output of the NAND gate NAND3 rises and the output of the NAND gate NAND4 trails. In this instance, an influence by the above signal transition appears in the data signal selecting line S3-P first of all and the data signal selecting line S3-P is set to the L level. Subsequently, the inverter IV3 trails, the outputs of the OR gates OR2 and OR4 trail, and further, the data signal selecting line S4-P is set to the H level after the elapse of a delay time. Thereafter, the inverter IV4 rises and the outputs of the OR gates OR1 and OR3 rise. In this manner, the similar operation is repeated hereinafter.

In the embodiment 6 described above, in the multiplexer circuit, even if the switching devices are replaced by the n-channel MOS transistors and transmission gates are used, effects similar to those in the embodiment 5 can be obtained.

Embodiment 7

Figure 18:
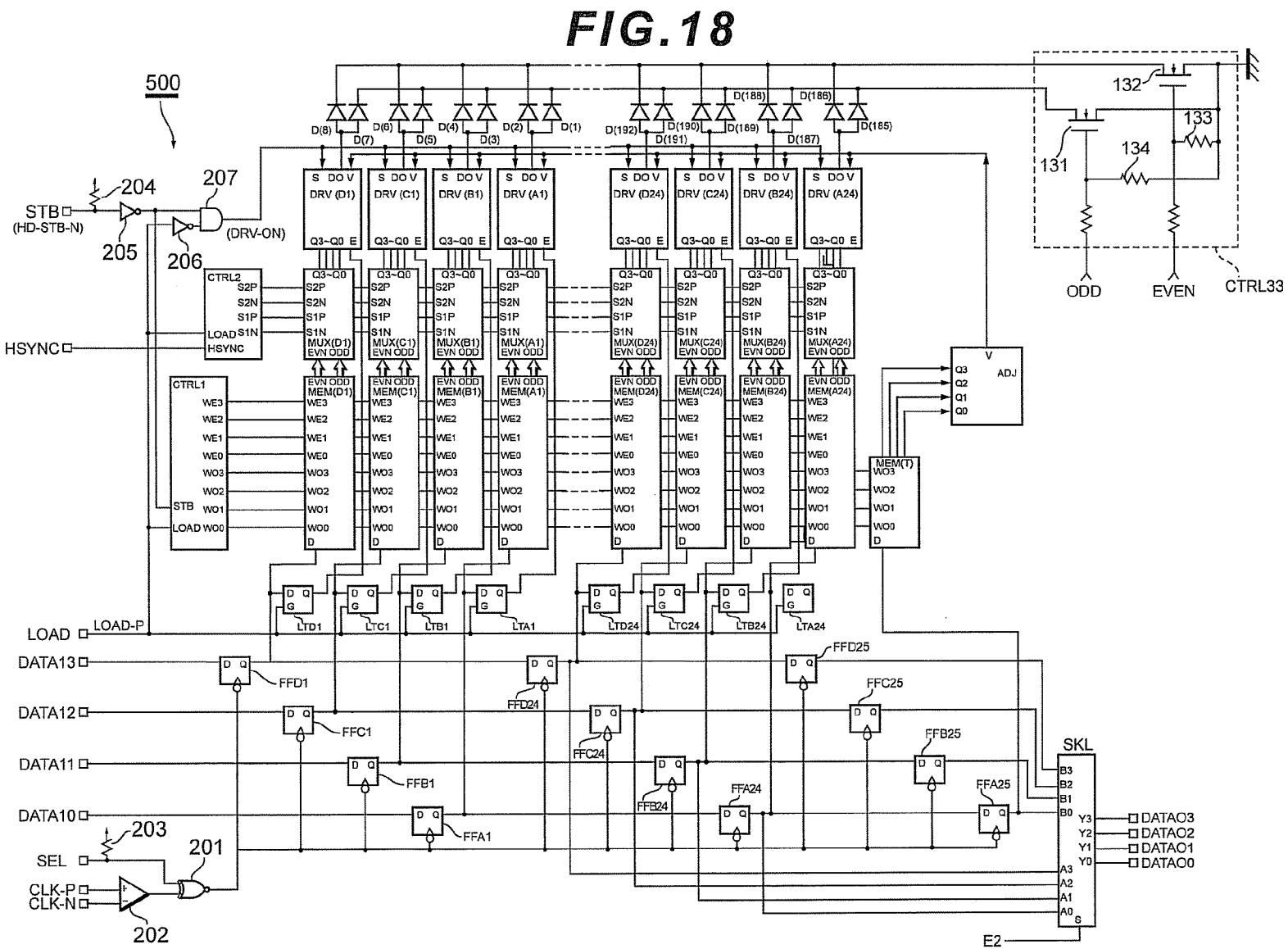
FIG. 18 is a block constructional diagram of a driver IC according to an embodiment 7.

FIG. 18 is a block constructional diagram of a driver IC of an embodiment 7.

As shown in the diagram, a driver IC 500 of the embodiment 7 is constructed merely by replacing the control circuit CTRL3 in the driver IC 100 in the embodiment 1 by a control circuit CTRL33. Other portions are substantially similar to those of the driver IC 100 in the embodiment 1. Therefore, only the control circuit CTRL33 will be described in detail hereinbelow.

The control circuit CTRL33 is a portion for receiving switching signals (ODD, EVEN) from a CPU (not shown) and allowing the cathode terminals (second terminals) of the foregoing first LED device group and second LED device group to be alternatively connected to the ground. Reference numerals 131 and 132 denote n-channel power MOS transistors and 133 and 134 indicate resistors. A source electrode of the n-channel power MOS transistor 131 is connected to the ground. A drain electrode of the n-channel power MOS transistor 131 is connected to the cathodes of the set of the odd-number designated LED devices (first LED device group). A drain electrode of the n-channel power MOS transistor 132 is connected to the cathodes of the set of the even-number designated LED devices (second LED device group).

A gate electrode of the n-channel power MOS transistor 131 is connected to the ODD terminal, receives a control signal, and is ON/OFF controlled. A gate electrode of the n-channel power MOS transistor 132 is connected to the EVEN terminal, receives a control signal, and is ON/OFF controlled. The controlling operation will be described with reference to FIG. 18.

Step S7-1

When the LED driving circuits DRV(A1) to DRV(D24) receive the sync signal HSYNC-N showing the start of the printing of one line, they output the data of dot 1, dot 3, dot 5, dot 7, . . . . At this time, the control signal is inputted to the ODD terminal and the gate of the n-channel power MOS transistor 131 is set to the H level. Thus, the first LED device group is made conductive and emits the light.

Step S7-2

Subsequently, the LED driving circuits DRV(A1) to DRV (D24) output the data of dot 2, dot 4, dot 6, dot 8, . . . . At this time, the control signal is inputted to the EVEN terminal and the gate of the n-channel power MOS transistor 132 is set to the H level. Thus, the second LED device group is made conductive and emits the light. The similar operation is repeated hereinafter.

As described above, according to the embodiment, in place of the npn bipolar transistors used in the related art, by providing the first power MOS transistors which are connected to the cathode electrodes of all of the LED devices belonging to the first LED device group and the second power MOS transistors which are connected to the cathode electrodes of all of the LED devices belonging to the second LED device group, the ON resistance can be suppressed to the small value although the chip area is small and such an effect that the costs of the LED head can be reduced is obtained. Although the control circuit CTRL33 according to the embodiment has been limited and applied to the embodiment 7 in the above description, the invention is not limited to such an example. That is, naturally, the control circuit CTRL33 of the embodiment can be applied to all of the foregoing embodiments.

Although the case where the LED devices are used as driven devices has been described above as an example, the invention is not limited to such an example. The invention can be also applied to the case where organic EL devices or, further, exothermic resistors, or the like in a thermal printer are used in place of the LED devices.

It should be understood by those skilled in the art that various modifications, combinations, sub-combinations and alterations may occur depending on design requirements and other factors insofar as they are within the scope of the appended claims or the equivalents thereof.

What is claimed is:

1. A driving apparatus for driving a plurality of driven devices which are arranged in accordance with a predetermined rule, comprising:

a first dot memory group and a second dot memory group in which a plurality of dot memories for storing correction values of powers which are applied to said driven devices every said driven device are alternately distributed in layout order of said plurality of driven devices;

a common data line which serially connects said first dot memory group and said second dot memory group in the layout order of said driven devices so as to form each pair;

first word lines connected to all of the dot memories of said first dot memory group;

second word lines connected to all of the dot memories of said second dot memory group; and a data writing section which supplies the correction values for said first dot memory group and the correction values for said second dot memory group to said common data line in accordance with the layout order of said driven devices while shifting timing and supplies writing signals to said first word lines and said second word lines at predetermined timing.

2. The driving apparatus according to claim 1, wherein each of a plurality of said memory cells constructing said dot memory is formed by two inverters which are mutually serially connected, and said data writing section has an MOS transistor in which a first electrode is connected to said inverters, a second electrode is connected to said common data line, and a gate electrode is connected to either said first word line or said second word line.

3. The driving apparatus according to claim 1, further comprising:

a first driven device group and a second driven device group in which first electrodes of the adjacent devices among said driven devices are mutually connected and second electrodes of said driven devices are alternately distributed in the layout order of said plurality of driven devices;

a first power MOS transistor connected to said second electrodes of all of the driven devices belonging to said first driven device group;

a second power MOS transistor connected to said second electrodes of all of the driven devices belonging to said second driven device group; and a drive switching section which allows the second electrodes of said driven devices to be alternately connected to the ground through both of said first and second power MOS transistors.

4. The driving apparatus according to claim 1, further comprising:

a first driven device group, a second driven device group, a third driven device group, and a fourth driven device group in which first electrodes of the four adjacent devices among said driven devices are mutually connected and second electrodes of said driven devices are alternately distributed in the layout order of said plurality of driven devices;

a first power MOS transistor connected to said second electrodes of all of the driven devices belonging to said first driven device group;

a second power MOS transistor connected to said second electrodes of all of the driven devices belonging to said second driven device group;

a third power MOS transistor connected to said third electrodes of all of the driven devices belonging to said third driven device group;

a fourth power MOS transistor connected to said fourth electrodes of all of the driven devices belonging to said fourth driven device group; and a drive switching section which allows the second electrodes of said driven devices to be alternately connected to the ground through said first to fourth power MOS transistors.

5. A driving apparatus for driving a plurality of driven devices which are arranged in accordance with a predetermined rule, comprising:

a first dot memory group and a second dot memory group in which a plurality of dot memories for storing correction values of powers which are applied to said driven devices every said driven device are alternately distributed in layout order of said plurality of driven devices;

a common word line which connects said first dot memory group and said second dot memory group in common;

first data lines connected to the dot memories of said first dot memory group;

second data lines connected to the dot memories of said second dot memory group; and a data writing section which sets said first data lines and said second data lines to data line pairs in the layout order of said driven devices, supplies the correction values for said first dot memory group and the correction values for said second dot memory group to each of said data line pairs in accordance with the layout order of said driven devices while shifting timing, and supplies writing signals to said common word line at predetermined timing.

6. The driving apparatus according to claim 5, wherein each of the memory cells constructing said dot memory is formed by two inverters which are mutually serially connected, and said data writing section has a first MOS transistor in which a first electrode is connected to said inverters and a gate electrode is connected to said common word line and a second MOS transistor in which a first electrode is connected to a second electrode of said first MOS transistor, a second electrode is connected to said first data line or said second data line, and a gate electrode is connected to a data signal selecting line, and on the basis of a switching signal which is received through said data signal selecting line, said data writing section switches the supply of said correction values for said first dot memory group and the supply of said correction values for said second dot memory group while shifting the timing every said first dot memory group and said second dot memory group.

7. The driving apparatus according to claim 5, further comprising:

a third dot memory group, and a fourth dot memory group in which a plurality of dot memories for storing correction values of powers which are applied to said driven devices every said driven device are alternately distributed in layout order of said plurality of driven devices;

third data lines connected to the dot memories of said third dot memory group; and fourth data lines connected to the dot memories of said fourth dot memory group, wherein said common word line connects said first dot memory group, said second dot memory group, said third dot memory group, and said fourth dot memory group in common; and said data writing section sets said first data lines, said second data lines, said third data lines, and said fourth data lines to data line groups in the layout order of said driven devices, supplies the correction values for said first dot memory group, the correction values for said second dot memory group, the correction values for said third dot memory group, and the correction values for said fourth dot memory group to each of said data line groups in accordance with the layout order of said driven devices while shifting timing, and supplies writing signals to said common word line at predetermined timing.

8. The driving apparatus according to claim 7, wherein each of the memory cells constructing said dot memory is formed by two inverters which are mutually serially connected, and said data writing section has a first MOS transistor in which a first electrode is connected to said inverters and a gate electrode is connected to said common word line and a second MOS transistor in which a first electrode is connected to a second electrode of said first MOS transistor, a second electrode is connected to one of said first data line, said second data line, said third data line, and said fourth data line, and a gate electrode is connected to a data signal selecting line, and on the basis of a switching signal which is received through said data signal selecting line, said data writing section switches the supply of said correction values for said first dot memory group, the supply of said correction values for said second dot memory group, the supply of said correction values for said third dot memory group, and the supply of said correction values for said fourth dot memory group while shifting the timing every said first dot memory group, said second dot memory group, said third dot memory group, and said fourth dot memory group.

9. A driving apparatus for driving a plurality of driven devices which are arranged in accordance with a predetermined rule, comprising:

a first dot memory group and a second dot memory group in which a plurality of dot memories for storing correction values of powers which are applied to said driven devices every said driven device are alternately distributed in layout order of said plurality of driven devices;

a correction value reading section which connects the dot memories of said first dot memory group and the dot memories of said second dot memory group in the layout order of said driven devices so as to form each pair;

a reading position switching section which switches the reading of the correction values of said first dot memory group and the reading of the correction values of said second dot memory group which are executed by said correction value reading section while shifting timing; and a switching signal generating section which supplies a switching signal to said reading position switching section, wherein said switching signal generating section supplies said switching signal to said reading position switching section and allows timing for turning off the switching signal to be included in a period of time until a subsequent switching signal is supplied.

10. The driving apparatus according to claim 9, further comprising:

a third dot memory group, and a fourth dot memory group in which a plurality of dot memories for storing correction values of powers which are applied to said driven devices every said driven device are alternately distributed in layout order of said plurality of driven devices, wherein said correction value reading section which connects the dot memories of said first dot memory group, the dot memories of said second dot memory group, the dot memories of said third dot memory group, the dot memories of said fourth dot memory group in the layout order of said driven devices so as to form each group; and said reading position switching section which switches the reading of the correction values of said first dot memory group, the reading of the correction values of said second dot memory group, the reading of the correction values of said third dot memory group, the reading of the correction values of said fourth dot memory group which are executed by said correction value reading section while shifting timing.

11. An LED head comprising:

a driving apparatus for driving a plurality of driven devices which are arranged in accordance with a predetermined rule; and LED (Light Emitting Diode) devices as said driven devices which are driven by said driving apparatus, wherein said driving apparatus includes:

a first dot memory group and a second dot memory group in which a plurality of dot memories for storing correction values of powers which are applied to said driven devices every said driven device are alternately distributed in layout order of said plurality of driven devices;

a common data line which serially connects said first dot memory group and said second dot memory group in the layout order of said driven devices so as to form each pair;

first word lines connected to all of the dot memories of said first dot memory group;

second word lines connected to all of the dot memories of said second dot memory group; and a data writing section which supplies the correction values for said first dot memory group and the correction values for said second dot memory group to said common data line in accordance with the layout order of said driven devices while shifting timing and supplies writing signals to said first word lines and said second word lines at predetermined timing.

12. An image forming apparatus, comprising:

a LED head, wherein said LED head includes:

a driving apparatus for driving a plurality of driven devices which are arranged in accordance with a predetermined rule; and LED (Light Emitting Diode) devices as said driven devices which are driven by said driving apparatus, wherein said driving apparatus includes:

a first dot memory group and a second dot memory group in which a plurality of dot memories for storing correction values of powers which are applied to said driven devices every said driven device are alternately distributed in layout order of said plurality of driven devices;

a common data line which serially connects said first dot memory group and said second dot memory group in the layout order of said driven devices so as to form each pair;

first word lines connected to all of the dot memories of said first dot memory group;

second word lines connected to all of the dot memories of said second dot memory group; and a data writing section which supplies the correction values for said first dot memory group and the correction values for said second dot memory group to said common data line in accordance with the layout order of said driven devices while shifting timing and supplies writing signals to said first word lines and said second word lines at predetermined timing.

wherein an image is formed by allowing a plurality of said LED devices included in said LED head to selectively perform light emission.

* * * * *